US006585079B1

(12) United States Patent
Weyer

(10) Patent No.: US 6,585,079 B1
(45) Date of Patent: Jul. 1, 2003

(54) WORK PLATFORM WITH ROTARY ACTUATOR

(75) Inventor: Dean R. Weyer, Enumclaw, WA (US)

(73) Assignee: 1994 Weyer Family Limited Partnership, Enumclaw, WA (US)

( * ) Notice: Subject to any disclaimer, the term of this patent is extended or adjusted under 35 U.S.C. 154(b) by 0 days.

(21) Appl. No.: 09/461,673

(22) Filed: Dec. 14, 1999

(51) Int. Cl.[7] ..... B66F 11/04
(52) U.S. Cl. ..... 182/2.7; 182/18
(58) Field of Search ..... 182/18, 2.1–2.11

(56) References Cited

U.S. PATENT DOCUMENTS

| | | | | |
|---|---|---|---|---|
| 3,599,739 A | * | 8/1971 | Hyer | |
| 4,031,964 A | | 6/1977 | Takahashi et al. | 172/9 |
| 4,179,010 A | | 12/1979 | Ashworth | 182/2 |
| 4,326,601 A | * | 4/1982 | Grove et al. | 182/18 |
| 4,422,366 A | * | 12/1983 | Weyer | |
| 4,456,093 A | * | 6/1984 | Finley et al. | 182/18 |
| 4,508,016 A | * | 4/1985 | Weyer | |
| 4,799,562 A | * | 1/1989 | Burrows et al. | |
| 5,746,286 A | * | 5/1998 | Mlaker | 182/2.9 |

FOREIGN PATENT DOCUMENTS

| | | |
|---|---|---|
| JP | 63-180700 | 11/1988 |
| JP | 09-067099 | 3/1997 |

* cited by examiner

*Primary Examiner*—Alvin Chin-Shue
(74) *Attorney, Agent, or Firm*—David Wright Tremaine LLP; George C. Rondeau, Jr.

(57) ABSTRACT

A fluid-powered rotatable work platform assembly for use with a vehicle such as a vehicle having an arm for positioning the assembly. The assembly includes a work platform or support configured to support a load, a body having a cavity extending along a longitudinal axis, and an output shaft rotatably disposed within the body generally coaxial with the longitudinal axis. A linear-to-rotary force transmitting member is positioned within the cavity of the body and engaged with the body and the output shaft to translate linear motion of the force transmitting member to rotational motion of one of the output shaft and the body relative to the other. The work platform is coupled to one of the body and the output shaft with at least one link and the arm of the vehicle is coupled to the other of the body and the output shaft so that when the output shaft and the body rotate relative to one another, the work platform rotates relative to the arm of the vehicle, while the pivoting link allows the work platform to move downward under the load. A sensor is operatively coupled to the work platform to sense the downward movement and/or an increasing load on the work platform.

57 Claims, 14 Drawing Sheets

WORK PLATFORM WITH ROTARY ACTUATOR

TECHNICAL FIELD

The present invention relates generally to aerial work platforms and, more particularly, to laterally rotatable work platforms.

BACKGROUND OF THE INVENTION

Aerial work platforms for the construction industry are typically mounted at the end of a boom that extends outwardly from a wheeled vehicle. The vehicle and the boom are movable to position the work platform at a desired location. The boom can extend and retract to raise and lower the work platform to a desired vertical location. Some work platforms can also be rotated relative to the boom in a lateral plane to point the work platform at a desired angle in the lateral plane relative to the boom. Accordingly, the work platform can be maneuvered to position a user adjacent to an elevated work site.

In one conventional device, the work platform is mounted to the boom of the vehicle with two parallel, pivotable links. The links and the work platform are biased to a horizontal position with a coiled spring. As the load on the work platform is increased, the spring compresses and the parallel links allow the work platform to descend slightly relative to the boom while the work platform remains approximately horizontal. A sensor coupled to the boom can trigger an alarm or a signal when the load on the platform (and therefore the vertical deflection of the platform) exceeds a selected amount. For example, the sensor can include a first switch that triggers an audible alarm when the load on the work platform exceeds a first selected value, and a second switch that shuts down motion of the work platform when the load thereon exceeds a second, greater value. Accordingly, the sensor can warn the user when the load on the work platform approaches a selected capacity and can prevent further movement of the work platform if the selected capacity is exceeded, reducing the likelihood for potential safety hazards associated with using the work platform.

In one aspect of this conventional device, the work platform can be rotated relative to the boom in the lateral plane with a rack and pinion arrangement. For example, a rack can be attached to the work platform and can engage the teeth of a pinion fixedly attached to the boom. As the rack is driven linearly back and forth in the lateral plane relative to the fixed pinion (for example, with a pressurized hydraulic fluid), the rack and the work platform will rotate in the lateral plane about the fixed pinion. Alternatively, the rack and pinion can be replaced with a worm gear drive for rotating the work platform relative to the boom, and/or the two parallel links can be replaced with a single link and a spaced-apart cam and cam follower combination.

One drawback with the foregoing attachment and rotation devices is that they can be heavy. The weight of the devices can reduce the weight that can be allocated to the load on the work platform, in effect reducing the capacity of the work platform. Alternatively, the weight of the devices can limit the lateral distance that the boom can extend relative to the vehicle before the vehicle becomes unstable.

Another drawback is that the foregoing attachment and rotation devices can be bulky, which can make the devices difficult to integrate with the work platform and/or difficult to install and maintain. Furthermore, it can be difficult to shield the bulky conventional devices from inadvertent contact with surrounding structures, making the devices more susceptible to damage during normal use.

SUMMARY OF THE INVENTION

The present invention is directed toward fluid-powered, rotatable support platform assembly usable with an assembly support such as a vehicle having an arm for selectively positioning such an assembly. In one embodiment, the assembly can include a load platform having a support surface for supporting a load, a body having a cavity extending along a longitudinal axis of the body, and a shaft rotatably disposed within the body and having a shaft axis generally aligned with the longitudinal axis of the body. One of the body or the shaft is configured to be coupled to the assembly support platform, and the other one of the body and the shaft is configured to provide rotary drive to the load support platform. A linear to-rotary force-transmitting member is positioned within the cavity of the body and is mounted for longitudinal movement within the body generally aligned with the longitudinal axis in response to selective application of pressurized fluid thereto. The force-transmitting member engages the body and the shaft to translate longitudinal motion of the force-transmitting member to rotational movement between the shaft and the body with a rotational force sufficient to selectively rotate the load support platform about the longitudinal axis relative to the assembly support in a rotational plane in clockwise and counterclockwise rotational directions.

A load sensor is positioned to detect a load on the load support platform in a load direction out of alignment with the rotational plane. A platform connector member is coupled between the load support platform and the other one of the body and shaft. The platform connector member is configured to permit movement of the load support platform in the load direction while restricting movement in directions out of alignment with the load direction except rotation of the load support platform in the rotational plane in response to the rotary drive. A load transmission member may be included to transmit the rotary drive to the load support platform.

The assembly can further include a spring positioned between the load support platform and the load transmission member to bias the load support platform in a direction opposite the load direction.

DETAILED DESCRIPTION OF THE INVENTION

The present invention is directed toward devices for rotating an aerial work platform or other support structure. The device can include a rotary actuator having a body, an output shaft within the body and a movable piston that rotates the output shaft relative to the body. One or the other of the output shaft and the body can be coupled to the work platform to rotate the work platform in a lateral plane. Many specific details of certain embodiments of the invention are set forth in the following description and in FIGS. 1A–14B to provide a thorough understanding of such embodiments. One skilled in the art, however, will understand that the present invention may have additional embodiments and that they may be practiced without several of the details described in the following description.

Figure 1A:
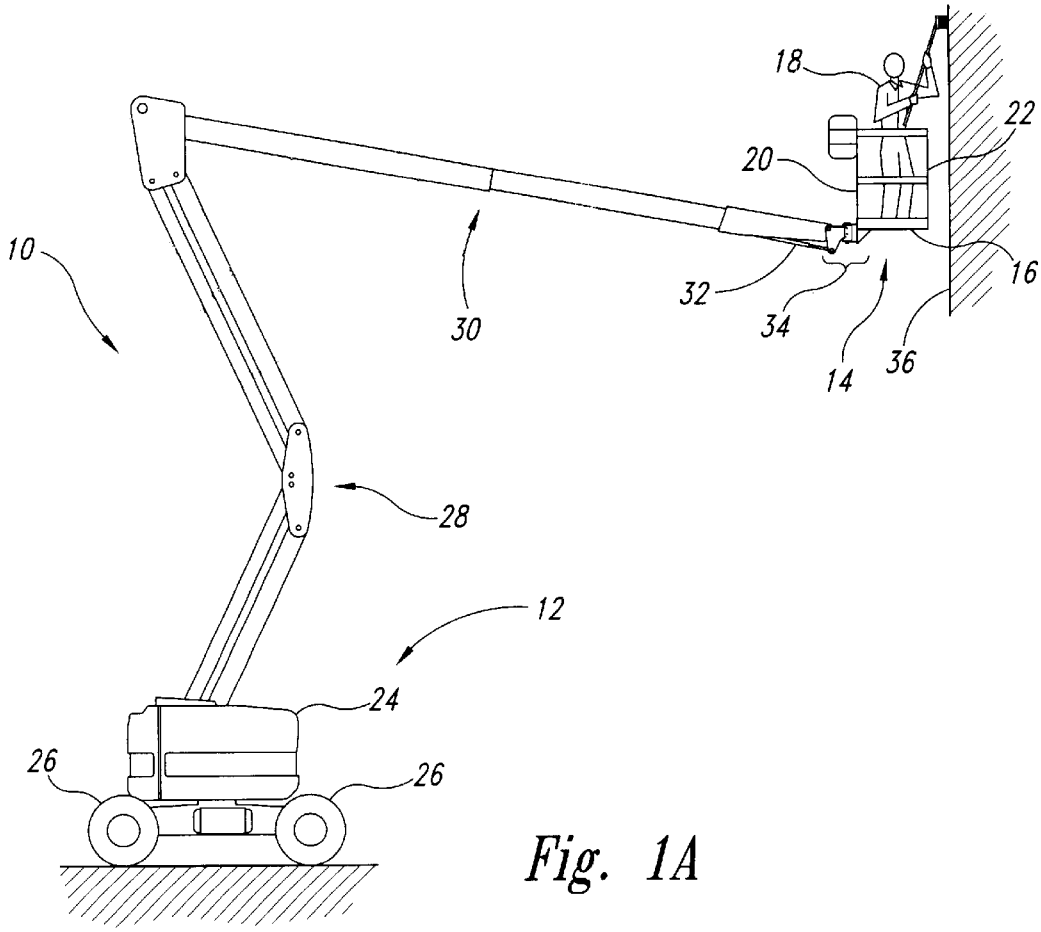
FIG. 1A is a side elevational view of an aerial work platform supported relative to a vehicle with a rotator assembly in accordance with an embodiment of the invention.

An apparatus 10 in accordance with an embodiment of the invention is shown in FIG. 1A as including a vehicle 12 that supports a load support member such as a work platform 14. The work platform 14 can have a support surface 16 for supporting a load that can include a user 18, tools, equipment and/or materials (not shown). A rear portion 20 of the work platform can face generally toward the vehicle 12 and a forward portion 22 can face away from the vehicle. In one embodiment, the vehicle 12 includes a drive unit 24 having wheels 26 for propelling the vehicle and the work platform 14 to a desired location. In other embodiments, the vehicle 12 can have tracks instead of wheels, or the wheels can engage rails, or the vehicle can be an unpowered vehicle, such as a towed trailer. In still further embodiments, the vehicle 12 can be a multi-purpose vehicle, such as a truck that can support the work platform 14 in addition to a separate payload. While the assembly support is shown as a vehicle, a stationary support platform which can position the apparatus 10 is contemplated.

The vehicle 12 can also include an articulated boom 28 and a telescoping arm 30 for supporting the work platform 14 and moving the work platform vertically and laterally relative to the vehicle 12. An actuator link 32 can adjust the tilt of the work platform 14 when the work platform moves up and down, as will be discussed below with reference to FIG. 3. The work platform 14 is coupled to the arm 30 with a rotator assembly 34 that can rotate the work platform 14 in a lateral plane (generally perpendicular to the plane of FIG. 3) relative to the arm 30. Accordingly, the work platform 14 can be maneuvered to place the load in a desired position adjacent a building wall 36 or other structure, for example during construction or maintenance activities.

Figure 1B:
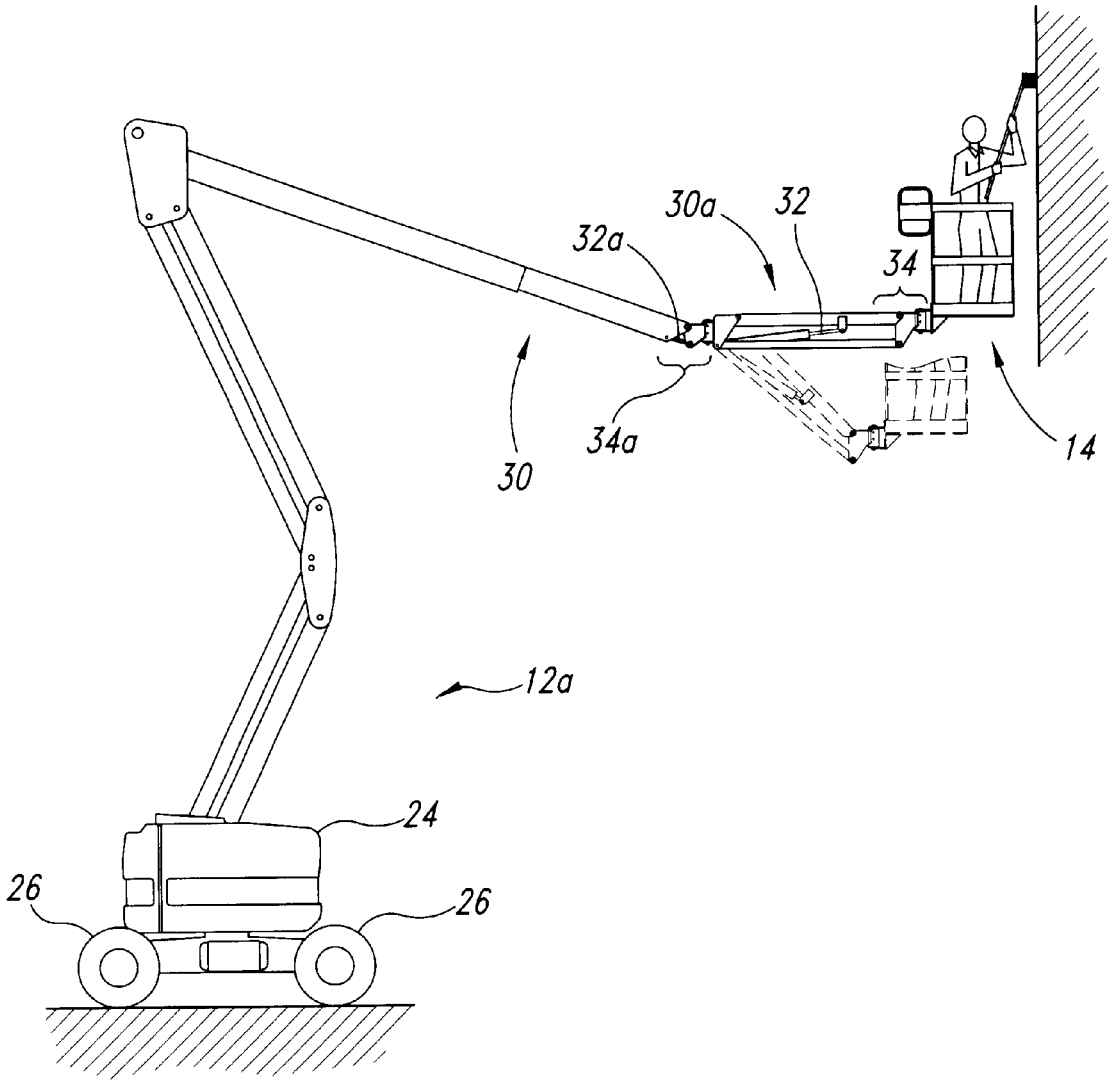
FIG. 1B is a side elevational view of an aerial work platform supported relative to a vehicle with a jib and a pair of rotator assemblies in accordance with another embodiment of the invention.

FIG. 1B is a side elevational view of vehicle 12*a* that supports the work platform 14 with a telescoping arm 30 coupled to a rotating jib 30*a*. The jib 30*a* is coupled between the work platform 14 and arm 30 by the rotator assembly 34 and a jib rotator assembly 34*a*. An actuator link 32*a* is coupled between the telescoping arm 30 and the jib 30*a* to pivot the work platform 14 upwardly and downwardly as shown in phantom lines in FIG. 1B. The jib rotator assembly 34*a* can pivot the jib 30*a* into and out of the plane of FIG. 1B, in a manner generally similar to that discussed below with reference to the rotator assembly 34.

Figure 2:
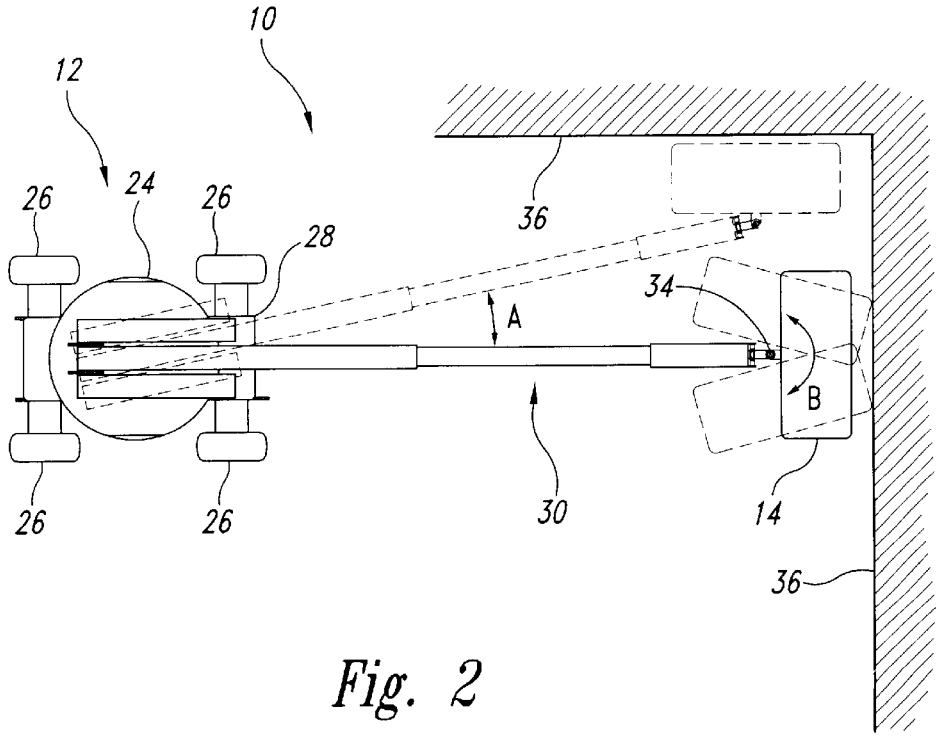
FIG. 2 is a top plan view of the vehicle shown in FIG. 1 with the work platform rotated in a lateral plane to a series of positions.

FIG. 2 is a top plan view of the apparatus 10 shown in FIG. 1A. As is shown in dashed lines, the arm 30 and the boom 28 of the apparatus 10 can rotate relative to the drive unit 24, as indicated by arrow A. The rotator assembly 34 can rotate the work platform 14 relative to the arm 30, as indicated by arrow B. Accordingly, the work platform 14 can be moved laterally to a variety of locations without moving the vehicle 12. For example, the work platform 14 can be moved along two adjoining building walls 36, while the vehicle 12 remains in a fixed position, as shown in FIG. 2.

Figure 3:
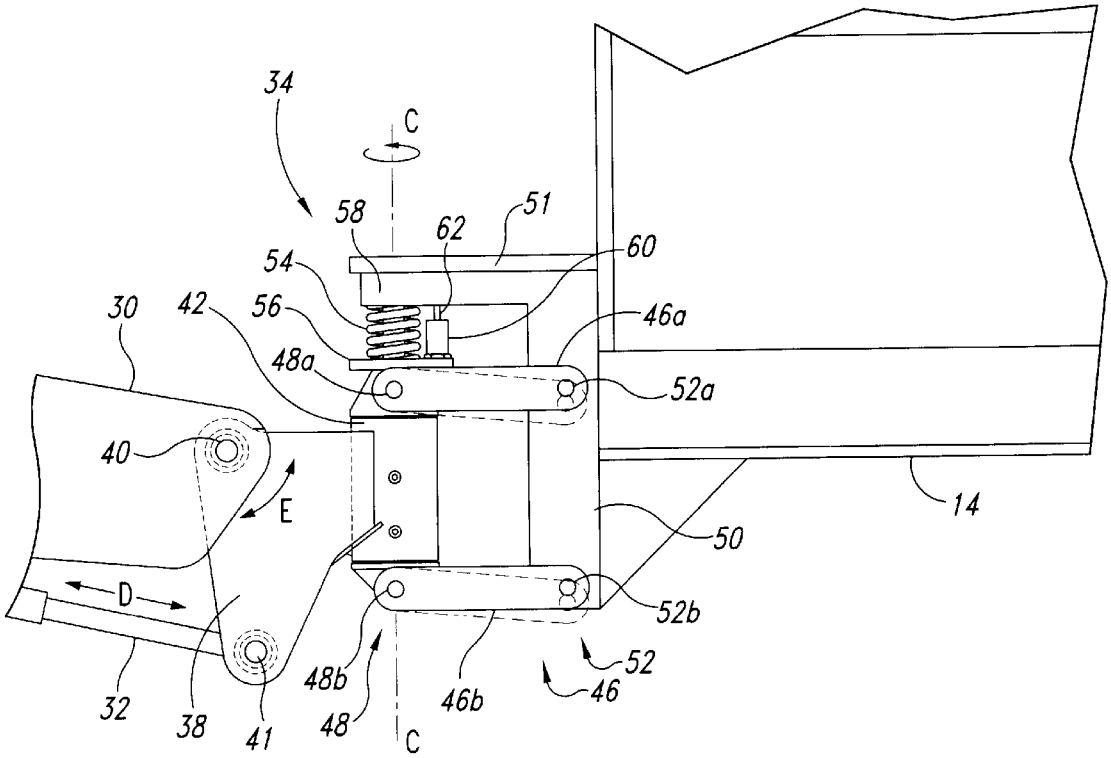
FIG. 3 is an enlarged side elevational view of the rotator work platform assembly and a portion of the work platform shown in FIG. 1.

FIG. 3 is an enlarged side elevational view of the rotator assembly 34 and a portion of the work platform 14 shown in FIG. 1A. The rotator assembly 34 is coupled between the arm 30 and the work platform 14 to support the work platform. For example, in one embodiment, the rotator assembly 34 includes an arm bracket 38 pivotally attached to the arm 30 at an arm pivot joint 40. The actuator link 32 is pivotally attached to the arm bracket 38 at pivot joint 41 below the pivot joint 40 and can extend and retract (as indicated by arrow D) to rotate the arm bracket 38 about the arm pivot joint 40 (as indicated by arrow E). Accordingly, the actuator link 32 can tilt the rotator assembly 34 and the work platform 14, or keep the work platform 14 approximately horizontal as the arm 30 moves the work platform about.

The rotator assembly 34 can further include a rotary actuator 42 that rotates the work platform 14 relative to the arm 30 in a rotational plane in clockwise and counterclockwise rotational directions about a longitudinal axis C—C, as will be discussed in greater detail below with reference to FIG. 4. The rotary actuator 42 can be rigidly welded to the arm bracket 38 to move with the arm bracket, or alternatively, the rotary actuator 42 can be rigidly connected to the arm bracket 38 with other connection arrangements. For example, the arm bracket 38 can include two flat panels that clamp the rotary actuator 42 therebetween and that are both coupled to the arm 30 at the pivot joint 40. In either embodiment, the rotator assembly 34 can also include two pairs of parallel corrector members or links 46 (shown as first and second upper links 46*a* and first and second lower links 46*b*) that allow the work platform 14 to rotate about an axis extending into the plane of FIG. 3 and perpendicular to axis C—C. The second upper link 46*a* is hidden behind the first upper link, which is visible in FIG. 3, and the second lower link 46*b* is hidden behind the first lower link, which is visible in FIG. 3. In one embodiment, the links 46 are pivotally attached at one end to the rotary actuator 42 with pivot joints 48 (shown as an upper pivot joint 48*a* and a lower pivot joint 48*b*). The opposite ends of the links 46 are pivotally attached to a platform bracket 50 at two pivot joints 52 (shown as an upper pivot joint 52*a* and a lower pivot joint 52*b*). The platform bracket 50 is fixedly attached to the work platform 14. Alternatively, single upper and lower links 46*a*, 46*b* can couple the rotary actuator 42 to the platform bracket 50. In either case, the links 46 can rotate about the pivot joints 48 and 52 to allow the work platform 14 to move upwardly and downwardly relative to the rotary actuator 42 while the work platform maintains a substantially horizontal orientation.

The links 46 can be biased to horizontal positions (shown in solid line in FIG. 3) with a spring 54 that fits between a spring support 56 of the rotary actuator 42 and a spring engaging portion 58 of a rearwardly extending load transfer arm 51 of the platform bracket 50. The load transfer arm 51 transmits at least a portion, and in this embodiment substantially all of the load supported by the work platform 14 through the spring 54 to an output shaft of the rotary actuator 42 and thereby supports the work platform against movement under a load in the downward direction. In one aspect of this embodiment, the spring 54 can be a coil spring that exerts an upward force on the spring engaging portion 58 of the platform bracket 50 to maintain the links 46 in their substantially horizontal orientations when the work platform 14 is unloaded. When a load is placed on the work platform 14, the spring 54 tends to compress and the work platform 14 moves downwardly as the links 46 rotate about the pivot joints 48 and 52 away from their horizontal positions (as shown in dashed lines in FIG. 3). For purposes of clarity, only the links 46 are shown in dashed lines in the downwardly rotated position. It will be understood that, although not shown in dashed lines in FIG. 3, the support bracket 50 and the work platform 14 swing downwardly with the links 46. The amount of the downward motion is exaggerated in FIG. 3 for purposes of illustration, and depends on the amount of compression the spring 54 experiences under the load on the work platform 14. While permitting movement of the work platform 14 in the selected downward direction under a load, and return in the upward direction when unloaded, the links 46 restrict movement in directions out of alignment with the selected load direction except for rotation of the work platform in the rotational plane in response to operation of the rotary actuator 42.

In a further aspect of this embodiment, the rotator assembly 34 can include a sensor 60 attached to the spring support 56 and engaging the spring engaging portion 58 of the platform bracket 50 for detecting vertical motion of the work platform 14 relative to the rotary actuator 42. In one aspect of this embodiment, the sensor 60 can include a normally open switch having a lever 62 that closes the switch when the work platform 14 descends by a selected amount under the weight of a selected load. In one aspect of this embodiment, the sensor 60 can trigger an audible or visual signal when the switch is closed. In a further aspect of this embodiment, the closed position of the switch can be the first of two closed positions. The switch can move to the second closed position when the work platform load exceeds a value larger than the load that moved the switch to the first position. When the switch is in the second closed position, it can be connected to halt further motion of the work platform 14 relative to the vehicle 10 (FIG. 1). For example, the switch can move to the first closed position (and trigger the audible or visual signal) when the load applied to the work platform 14 is 90% of a rated capacity. The switch can move to the second closed position (and halt further motion of the work platform) when the load reaches 125% of the rated capacity. In an alternate arrangement, the sensor 60 can have two separate switches or two separate sensors can be used to detect the two different load values. In any case, both the sensor 60 and the spring 54 rotate with the work platform 14 when the rotary actuator 42 rotates the work platform 14 about the longitudinal axis C—C, as will be discussed in greater detail below.

Figure 4:
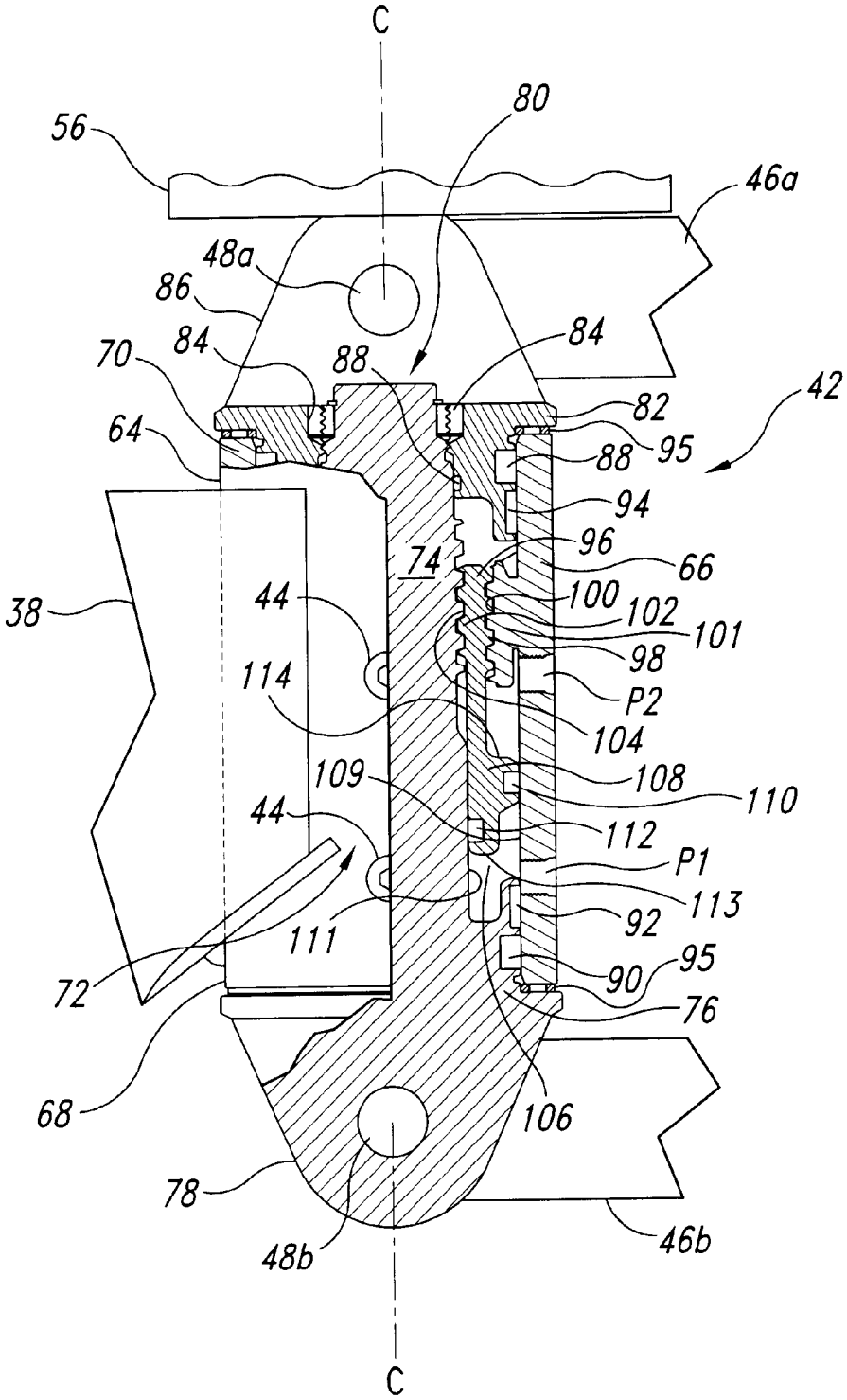
FIG. 4 is an enlarged, partially cut-away side elevational view of a rotary actuator of the rotator assembly shown in FIG. 3.

FIG. 4 is an enlarged, partially cut-away side elevational view of the rotary actuator 42. The rotary actuator 42 has an elongated housing or body 64 with a cylindrical sidewall 66 and first and second ends 68 and 70, respectively. Removable plugs 44 provide access to the interior of the housing 64. The body 64 includes an attachment portion 72 connected to the arm bracket 38, as discussed above. An elongated rotary drive or output shaft 74 is coaxially positioned within the body 64 and is supported for rotation relative to the body.

In one embodiment, the shaft 74 extends the full length of the body 64 and has an interior flange portion 76 at the first body end 68, and an exteriorly extending first attachment flange portion or clevis 78 extending exterior of the body at the first body end. Alternatively, the shaft 74 can extend less than the full length of the body 64, and/or can include two or more segments. The first attachment flange portion 78 is pivotally attached to the lower links 46*b* (the second of which is visible in FIG. 4) at the pivot joint 48*b*. The shaft 74 also has an extending shaft portion 80 extending beyond an exterior of the body 64 at the second body end 70. The shaft 74 has an annular carrier or endcap 82 threadably attached to the shaft toward the second body end 70, and secured to the shaft with pins 84 to prevent rotation of the endcap 82 relative to the shaft. The endcap 82 includes a second attachment flange portion 86 extending exterior of the body 64 at the second body end 70. The second attachment flange portion 86 is pivotally attached to the upper links 46*a* (the second of which is visible in FIG. 4) at the pivot joint 48*a*. In an alternate arrangement, the shaft portion 80 of the shaft 74 can be integrally formed with the second attachment flange portion 86, generally similar to the attachment arrangement between the shaft 74 and the first attachment flange portion 78.

Seals 88 are disposed between the endcap 82 and the shaft 74 and between the endcap 82 and the body sidewall 66 to provide a fluid-tight seal therebetween. A seal 90 is disposed between the interior flange portion 76 and the body sidewall 66 to provide a fluid-tight seal therebetween. A radial bearing 92 is disposed between the interior flange portion 76 and the body sidewall 66, and a radial bearing 94 is disposed between the endcap 82 and the body sidewall 66 to support the shaft 74 against radial loads. Thrust washers 95 are positioned between the first body end 68 and the interior flange portion 76 and between the second body end 70 and the endcap 82 to provide axial support for the interior flange portion and the endcap.

An annular piston sleeve 96 is reciprocally mounted within the body 64 coaxially about the output shaft 74. The piston sleeve 96 has outer splines, grooves or threads 98 over a portion of its length which mesh with inner splines, grooves or threads 100 of a ring gear portion 101 of the body sidewall 66. The piston sleeve 96 is also provided with inner splines, grooves or threads 102 which mesh with outer splines, grooves or threads 104 provided on a portion of the output shaft 74. At least one pair of meshing splines is helical to convert axial motion of the piston sleeve 96 to rotary motion of the output shaft 74. Alternatively, all the splines can be helical and/or can be threaded in the same direction (e.g., left-handed or right-handed) or different directions, depending on the desired direction and amount of output shaft rotation per unit of axial motion of the piston sleeve 96. It should be understood that while splines are shown in the drawings and described herein, the principle of the invention is equally applicable to any form of linear-to-rotary motion conversion arrangement, such as balls or rollers, and that the splines can include any type of groove or channel suitable for such motion conversion.

In one embodiment, the piston sleeve 96 has an annular piston head 108 positioned toward the second body end 68 with the shaft 74 extending therethrough. The shaft flange portion 76 has a circumferentially extending recess 106 which opens facing toward the second body end 70 and is sized to receive a lengthwise end portion of the piston head 108 of the splined piston sleeve 96 therein when the piston sleeve moves axially toward the first body end 68. The piston head 108 is sealed against a smooth inner wall surface 109 of the body sidewall 66 with an outer seal 110, and is sealed against a smooth outer wall surface 111 of the shaft 74 with an inner seal 112. The piston head 108 is slidably maintained within the body 64 for reciprocal movement, and undergoes longitudinal and (where the splines 98 and 102 are helical) rotational movement relative to the inner wall surface 109 of the body sidewall 66, as will be described in greater detail below.

The piston head 108 reciprocates within the body 64 when hydraulic oil, air, or any other suitable fluid under pressure selectively enters through one or the other of a first port P1 (which is in fluid communication with a fluid-tight compartment within the body 64 defined in part by the inner seal 112 and a first surface 113 of the piston head 108 facing toward the first body end 68), or through a second port P2 (which is in fluid communication with a fluid-tight compartment within the body 64 defined in part by the outer seal 110 and a second surface 114 of the piston head 108 facing toward the second body end 70). As the piston head 108 and the piston sleeve 96, of which the piston head is a part, linearly reciprocate in an axial direction within the body 64, the outer splines 98 of the piston sleeve engage or mesh with the inner splines 100 of the body sidewall 66 to cause rotation of the piston sleeve, where both the outer splines 98 and the inner splines 100 are helical. The linear and rotational movement of the piston sleeve 96 is transmitted through the inner splines 102 of the piston sleeve 96 to the outer splines 104 of the shaft 74 to rotate the shaft. The smooth wall surface 111 of the shaft 74 and the smooth wall surface 109 of the body sidewall 66 have sufficient axial length to accommodate the full end-to-end reciprocating stroke travel of the piston sleeve 96 within the body 64. Longitudinal movement of the shaft 74 is restricted, thus most movement of the piston sleeve 96 is converted into rotational movement of the output shaft 74. Depending on the slope and direction of turn of the various splines, there may be provided a multiplication of the rotary output of the shaft 74.

The application of fluid pressure to the first port P1 produces axial movement of the piston sleeve 96 toward the second body end 70. The application of fluid pressure to the second port P2 produces axial movement of the piston sleeve 96 toward the first body end 68. The rotary actuator 42 provides relative rotational movement between the body 64 and the shaft 74 through the conversion of linear movement of the piston sleeve 96 into rotational movement of the shaft 74, in a manner known in the art. The shaft 74 is selectively rotated by application of fluid pressure, and the rotation is transmitted to the work platform 14 (FIG. 3) to selectively rotate the work platform 14 about the longitudinal axis C—C. The rotary actuator 42 provides a rotational force sufficient to selectively rotate the work platform 14 when bearing a load relative to the vehicle 12 in the rotational plane. In the embodiment of FIGS. 3 and 4, the links 46 transmit the rotary drive of the shaft 74 to the work platform 14.

An advantage of the rotator assembly 34 shown in FIGS. 1A–4 is that it can be more compact than conventional arrangements. Accordingly, the rotator assembly 34 can be more easily shielded by surrounding portions of the apparatus 10, such as the work platform 14, and is less likely to come into incidental contact with structures around which the work platform is used. In addition, the rotator assembly 34 can have fewer parts than some conventional devices, and the body 64 of the rotator assembly can shield the internal components from incidental contact with users, increasing the safety and overall appearance of the rotator assembly. Furthermore, the more compact rotator assembly 34 can be more versatile than conventional arrangements because it can be attached to one or more of several portions of the work platform 14. For example, the rotator assembly 34 can be attached toward the rear of the work platform 14, as shown in FIGS. 1A–4, or alternatively, the rotator assembly can be attached to the bottom of the work platform 14 or toward the front of the work platform.

Another advantage is that the more compact rotator assembly 34 can be easier to install and maintain. Furthermore, the rotator assembly 34 can be lighter than conventional arrangements, effectively increasing the payload weight that can be supported by the work platform 14. Still further, the rotator assembly 34 can be more robust than some conventional arrangements, reducing the likelihood that the rotator assembly will be damaged in the event it does come into incidental contact with surrounding structures.

Figure 5:
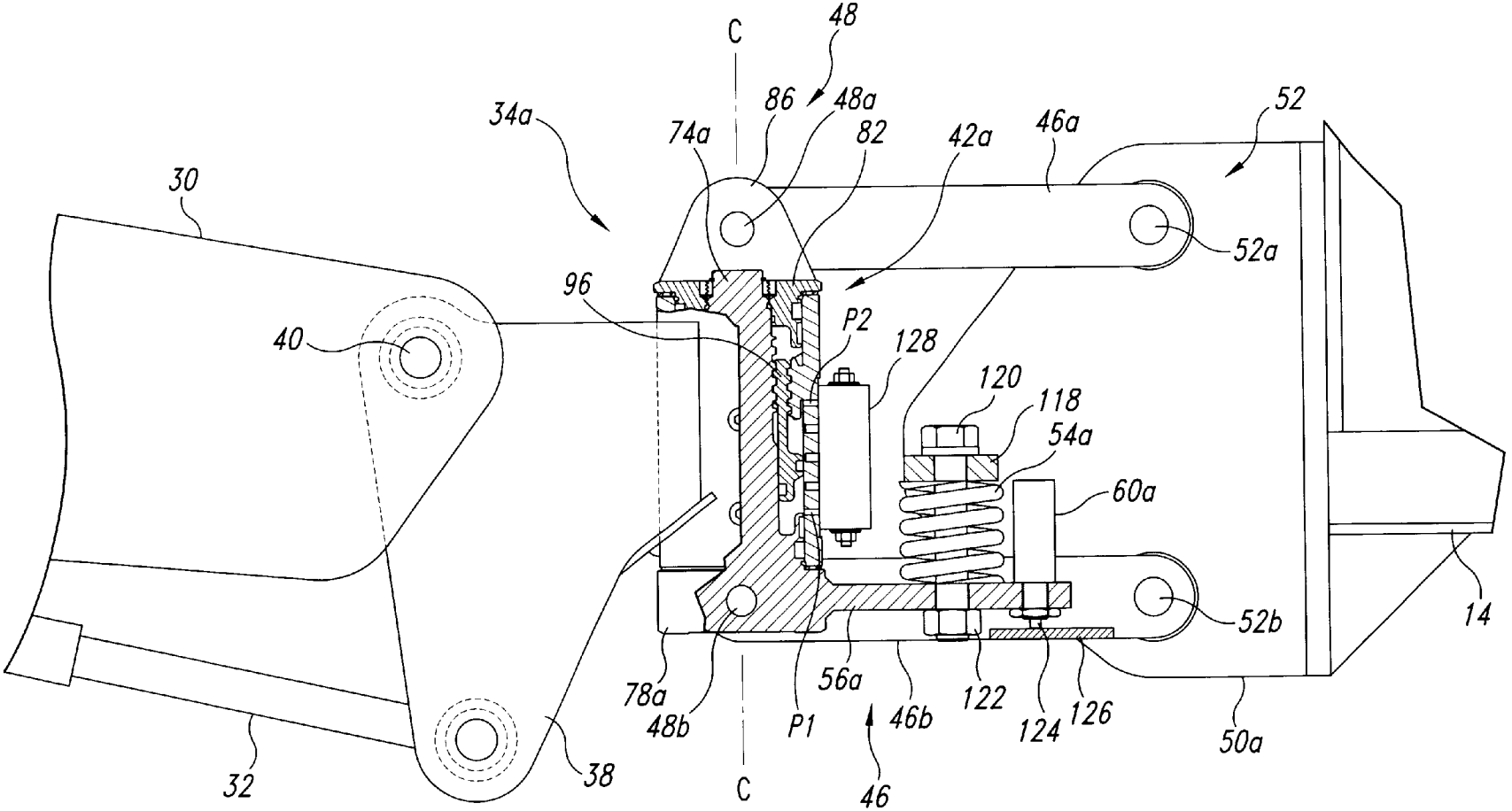
FIG. 5 is a partially cut-away side elevational view of a portion of a work platform assembly using a rotary actuator in accordance with another embodiment of the invention.

FIG. 5 is a partially cut-away side elevational view of a rotator assembly **34*a* coupled between the work platform 14 and the arm bracket 38 in accordance with another embodiment of the invention. The rotator assembly 34*a* can include a rotary actuator 42*a* having an endcap 82 and an output shaft 74*a*. The endcap 82 and the output shaft 74*a* are coupled to the second flange attachment portion 86 to pivotally support the upper links 46*a* (one of which is visible in FIG. 5) in a manner generally similar to that described above with reference to FIG. 3. The output shaft 74*a* can also be coupled to a first attachment flange portion 78*a*, which pivotally supports the lower links 46***b* (one of which is visible in FIG. 5) at the pivot joint 48*b*. In this embodiment a spring support portion 56*a* is attached to the output shaft 74*a* and can be formed as a part thereof, and extends laterally away from the rotary actuator 42*a* between the lower links 46*b*. The spring support portion 56*a* supports one end of a spring 54*a* which extends upwardly therefrom. The other end of the spring 54*a* is engaged by a spring bracket 118 attached to a platform bracket 50*a* that is in turn attached to the platform 14. The spring support portion 56*a* of the output shaft 74*a* also serves with the spring bracket as load transfer members to transmit at least a portion of the load supported by the work platform 14 to the output shaft and supports the work platform against significant movement under load in the downward direction. In one aspect of this embodiment, the spring 54*a* can be pre-loaded by tightening a bolt 120 extending longitudinally through the spring and a nut 122 to compress the spring 54*a*. An advantage of this arrangement is that the spring 54*a* will tend to remain in contact with both the spring bracket 118 and the spring support portion 56*a*, and the upward movement of the platform limited by the bolt 120, even when movement would otherwise tend to bounce the work platform up and down, for example, when the vehicle 12 (FIG. 1A) is in transit.

A sensor 60*a* is mounted to the spring support portion 56*a* and has a switch with a plunger or lever 124 that engages a contact plate 126 attached to the lower links 46*b*. In one aspect of this embodiment, the switch can be in a normally open position when the lever 124 contacts the contact plate 126 and can close when the contact plate descends away from the sensor 60*a*, for example, when a sufficient load is placed on the work platform 14. As was discussed above with reference to FIG. 3, the switch can be a three-position switch, to sense two different load values, or the sensor 60*a* can be one of two sensors, each of which detects a different load value.

The rotator assembly 34*a* can also include a counterbalance or other hydraulic valve 128 that receives pressurized fluid and delivers the fluid through the ports P1 and P2 of the rotary actuator 42*a*. The valve 128 can isolate the fluid within the rotary actuator 42*a* in a manner generally known to those skilled in the art, to prevent the pressurized fluid from leaking from the cylinder if fluid power to the rotary actuator 42*a* is unexpectedly interrupted. The valve 128 can accordingly maintain pressure on the piston sleeve 96 and prevent unexpected rotation of the output shaft 74*a* if power to the rotator assembly 34*a* is interrupted.

An advantage of the arrangement shown in FIG. 5 is that the sensor 60*a* and the spring 54*a* are positioned between the rotary actuator 42*a* and the work platform 14. Accordingly, the rotator assembly 34*a* can be more compact in a vertical direction than the rotator assembly 34 discussed above with reference to FIG. 3. Conversely, an advantage of the rotator assembly 34 shown in FIG. 3 is that by placing the spring 54 and the sensor 60 above the rotary actuator 42, the rotator assembly can be more compact in a forward direction.

Figure 6:
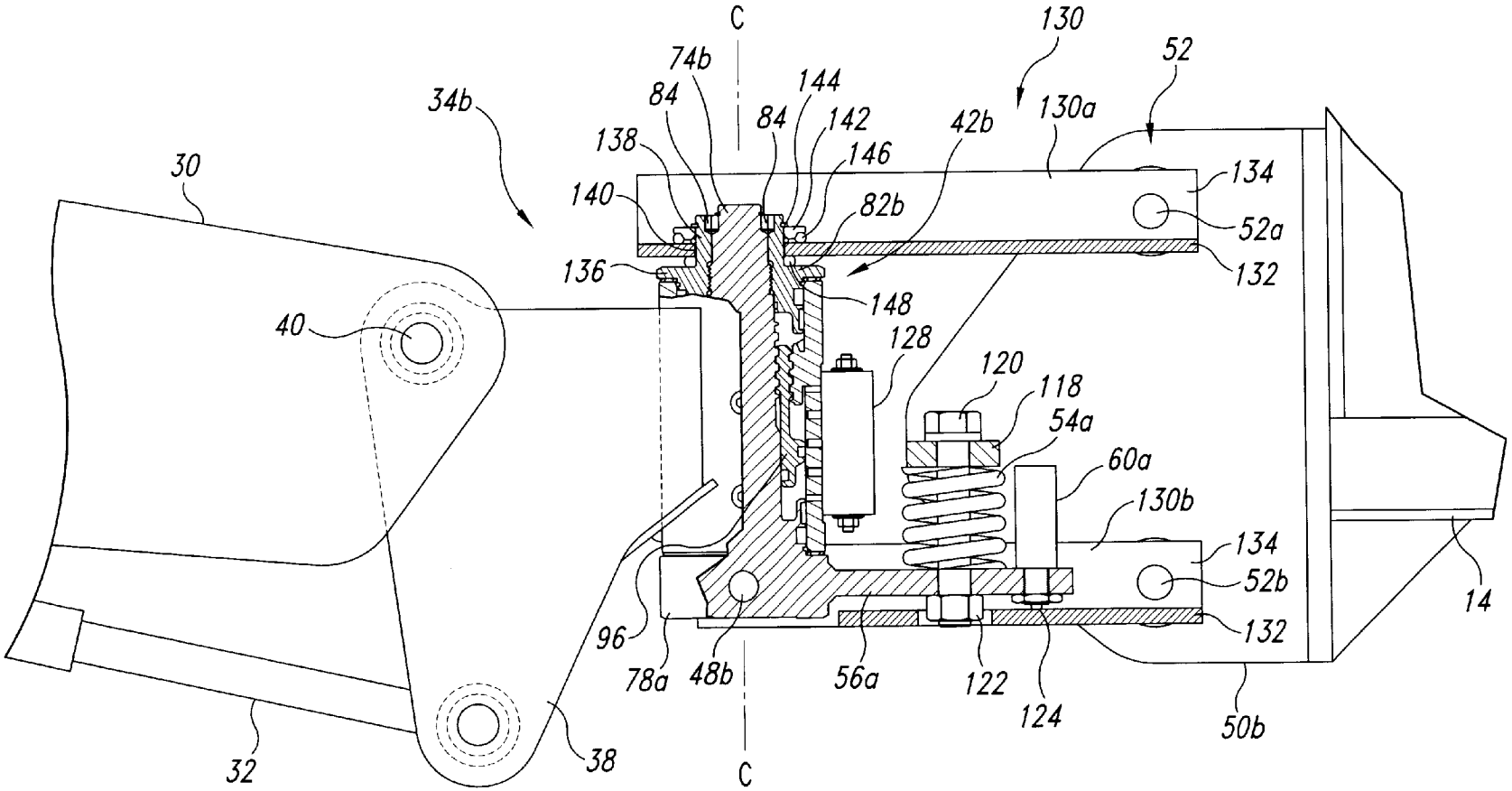
FIG. 6 is a partially cut-away side elevational view of a portion of a work platform assembly using a rotary actuator in accordance with yet another embodiment of the invention.

FIG. 6 is a partially cut-away side elevation view of a rotator assembly 34*b* coupled between the work platform 14 and the arm bracket 38 in accordance with yet another embodiment of the invention. The rotator assembly 34*b* includes the rotary actuator 42*b* that rotates the work platform 14 in a manner generally similar to that discussed above with reference to FIGS. 4 and 5. The rotary actuator 42*b* is coupled with two parallel upper and lower links 130 (shown as an upper link 130*a* and a lower link 130*b*) to a platform bracket 50*b* to allow vertical motion of the platform 14 relative to the rotary actuator 42*b*. The platform bracket 50*b* includes two generally flat parallel flanges (one of which is visible in FIG. 6) spaced apart in a direction perpendicular to the plane of FIG. 6 with the links 130 extending between the two panels. Each link 130 has a channel shape defined by a laterally-extending web 132 and two upwardly-extending flanges 134, one of which is visible in FIG. 6. In one aspect of this embodiment, the lower link 130*b* is pivotally connected between the platform bracket 50*b* and the lower attachment flange portion 78*a* of the rotary actuator 42*b* to operate in a manner generally similar to that discussed above with reference to FIG. 5. The lower attachment flange portion 78*a* includes a spring support portion 56*a* that supports the spring 54*a*, also in a manner generally similar to that discussed above with reference to FIG. 5. The upper link 130*a* is pivotally coupled at one end to an endcap 82*b* of the rotary actuator 42*b*, as will be discussed in greater detail below.

The endcap 82*b* is threaded to an output shaft 74*b* of the rotary actuator 42*b* and is pinned to the output shaft with pins 84 to prevent rotation of the endcap relative to the output shaft. The endcap 82*b* includes a shoulder 136 that is coaxial with an extends laterally away from the longitudinal axis C—C of the output shaft 74*b* and further includes a projection 138 that extends upwardly away from the shoulder 136. The projection 138 extends through an aperture 140 in the web 132 of the upper link 130*a*. A retainer 142 extends coaxially around the projection 138 and is held in place with a retainer clip 144. An upper O-ring 146 is positioned between the retainer 142 and an upper face of the web 132, and a lower O-ring 148 is positioned between a lower face of the web 132 and the shoulder 136. Accordingly, the upper link 130*a* can tilt up and down relative to the endcap 82*b* about an axis perpendicular to the longitudinal axis C—C by compressing portions of the upper O-ring 146 and the lower O-ring 148. This allows the up and down rotation of the upper and lower links 130*a* and 130*b* to permit the movement sensed by the sensor 60*a*. In an alternate arrangement, the O-rings 146, 148 can be replaced with other compressible members, such as wave washers.

Figure 7:
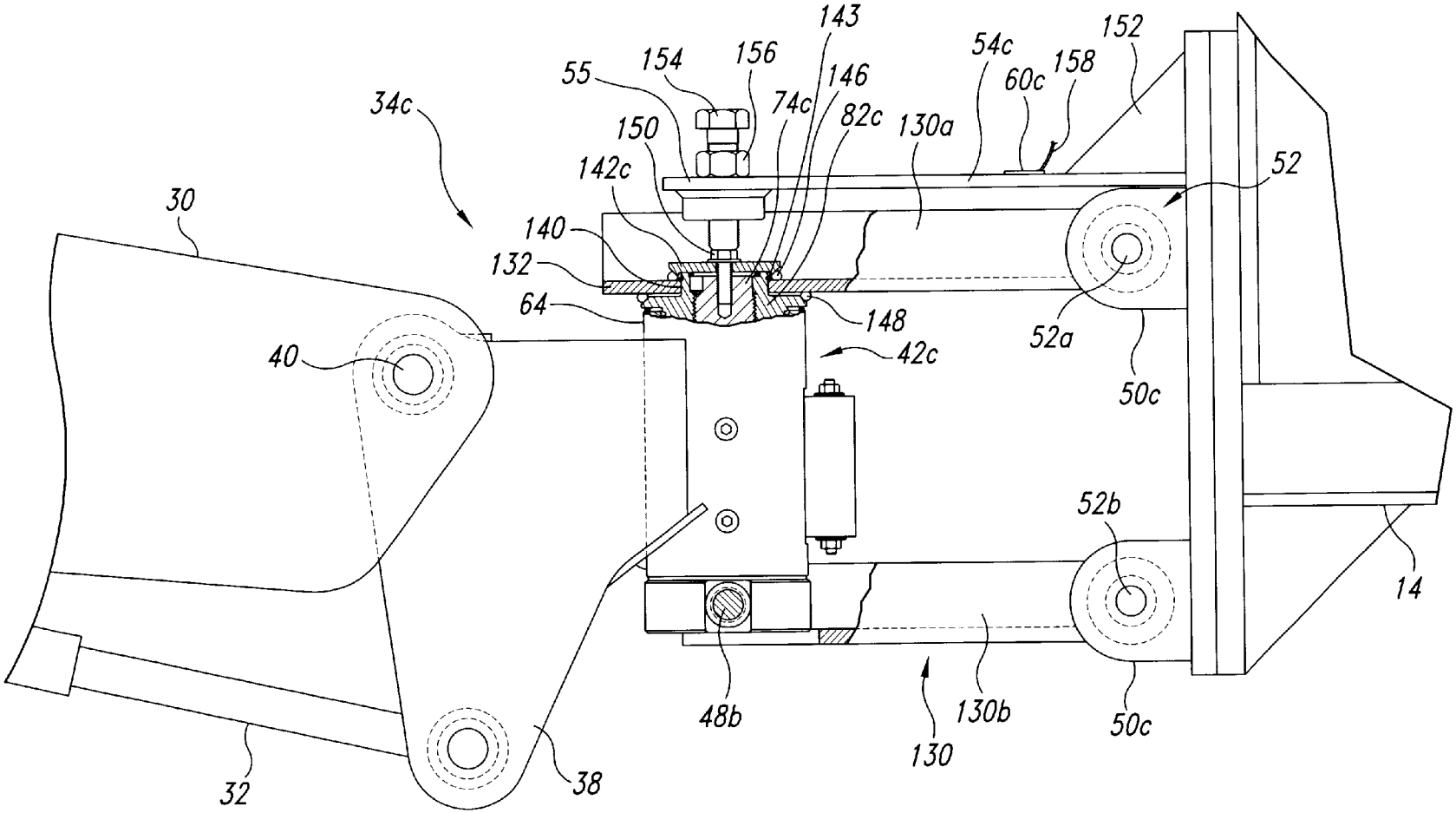
FIG. 7 is a partially cut-away side elevational view of a work platform assembly using a rotary actuator with a cantilever member having a strain gauge in accordance with yet another embodiment of the invention.

FIG. 7 is a partially cut-away side elevational view of a rotator assembly 34*c* coupled between the work platform 14 and the arm bracket 38 in accordance with still another embodiment of the invention. The rotator assembly 34*c* includes upper and lower parallel links 130*a* and 130*b* coupled between a rotary actuator 42*c* and two platform brackets 50*c* to pivotally support the work platform 14 relative to the rotary actuator in a manner generally similar to that discussed above with reference to FIG. 6. In one aspect of this embodiment, the rotary actuator 42*c* includes an endcap 82*c* threaded and pinned to an output shaft 74*c* (to prevent relative motion between the endcap 82*c* and the output shaft 74*c*) and extending upwardly through the aperture 140 of the upper link 130*a*. A retainer 142*c* is connected to the output shaft 74*c* with a bolt 150. Upper and lower O-rings 146 and 148 (or other compressible members) are positioned between the retainer 142*c* and an upper face of the upper link 130*a*, and between a lower face of the upper link 130*a* and the endcap 82*c*, respectively, generally in a manner as described above with reference to FIG. 6.

In a further aspect of this embodiment, the rotator assembly 34*c* includes a flexible and resilient cantilever member 54*c* attached at one end to the platform 14 with a spring bracket 152. The cantilever member 54*c* extends toward the rotary actuator 42*c* in a cantilevered fashion over the upper link 130*a* and has a free end 55 that rotatably bears against the rotary actuator through an adjustment bolt 154 to act as a spring. The cantilever member 54*c* transmits at least a portion of the load supported by the work platform 14 to the output shaft 74*c* and supports the work platform against downward movement under load except for the limited range of movement that results from flexure of the cantilever members. In one embodiment, the adjustment bolt 154 bears on the head of the bolt 150 that connects the retainer 142*c* to the output shaft 74*c*. In a further aspect of this embodiment, a retainer 143 adjacent to the upper O-ring 146 provides an additional load path between the endcap 82*c* and the upper link 130*a*. Alternatively, the adjustment bolt 154 can bear directly against the output shaft 74*c*, the endcap 82*c*, the body 64, or the upper link 130*a*, preferably at a position on the upper link adjacent to its attachment to the output shaft. In further alternative embodiments, the adjustment bolt 154 can bear against the upper link 130*a*, for example, by bearing against the web 132 of the upper link. In any of these embodiments, the cantilever member 54*c* resists downward rotation of the work platform 14 relative to the rotary actuator 42*c*, while still deflecting or bending when the load exceeds a selected value. In the illustrated embodiment, the adjustment bolt 154 can be tightened or loosened to adjust the height of the work platform 14 relative to the rotary actuator 42*c* and can be held against further rotation with a locknut 56. Alternatively, the adjustment bolt 154 can be configured to pre-tension the cantilever member 54*c* and restrict upward movement of the platform 14 during transit, as was discussed above with reference to FIG. 5. As noted above, the cantilever member 54*c* also resists downward motion of the platform 14 when the platform is loaded.

The rotator assembly 34*c* also includes a strain gauge 60*c* attached to a surface of the cantilever member 54*c* in a manner known to those skilled in the art to detect a strain (such as is caused by bending) of the cantilever member 54*c*. Accordingly, the strain gauge 60*c* detects the strain or deflection of the cantilever member 54*c* as the platform 14 is loaded, and triggers one or more warning signals in a manner generally similar to that discussed above with reference to the sensor 60 of FIG. 3. The strain gauge 60*c* can be coupled with a lead 158 to a signal processor (not shown) to process the strain gauge signals. In one embodiment, a single strain gauge 60*c* generates both a warning signal and a shut-down signal. Alternatively, multiple strain gages can be attached to the upper link 130*a* to generate multiple signals. The cantilever member 54*c* can have other strain gauge arrangements in other embodiments, and/or the strain gauge 60*c* can be coupled to members other than the cantilever member 54*c* that also deflect and/or strain when the platform 14 is loaded. Alternatively, the cantilever member 54*c* or other member can have a device other than a strain gauge 60*c* that detects deflection and/or deformation of the cantilever member. The strain gauge 60*c* or other device can also be configured to generate a read-out signal (corresponding to the load on the work platform 14) which is accessible to the user via a digital display or other display device.

Figure 8:
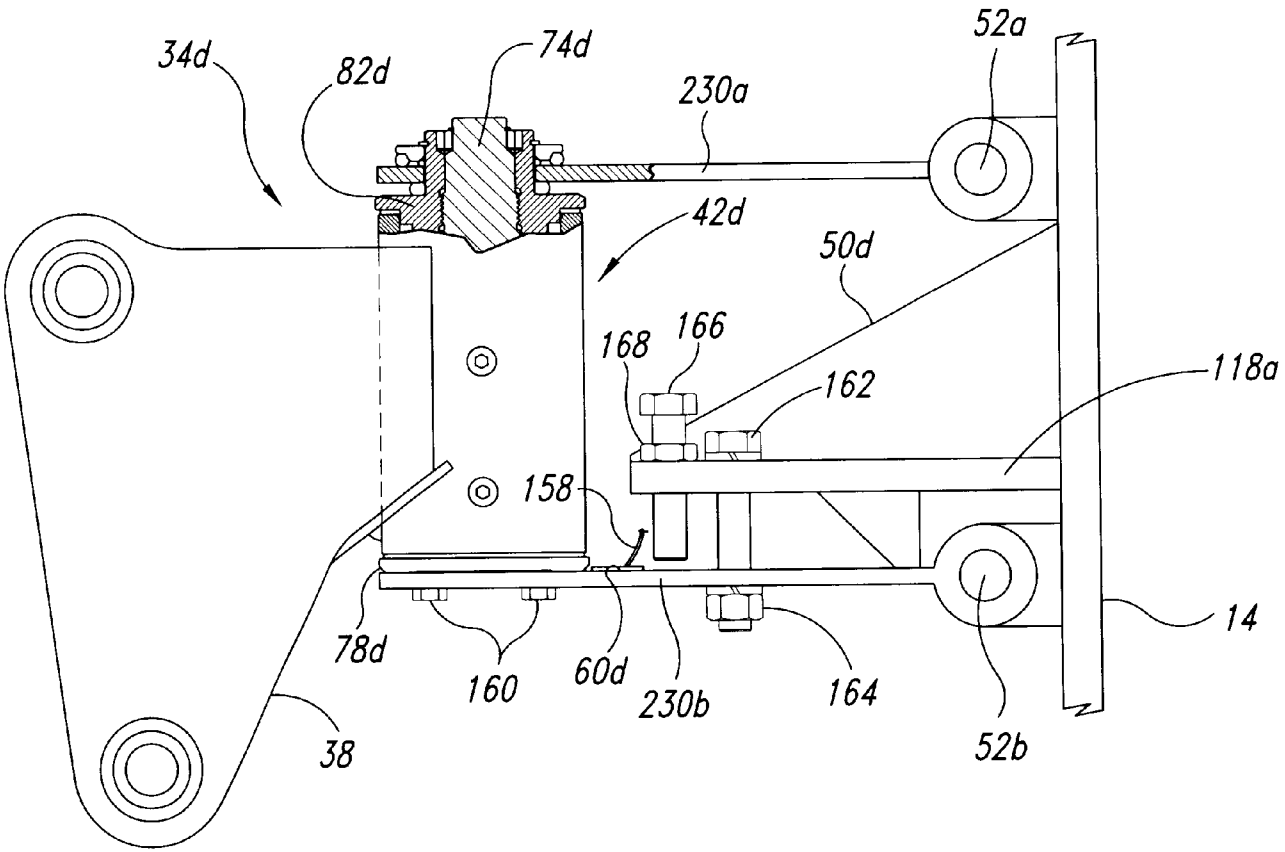
FIG. 8 is a partially cut-away side elevational view of a work platform assembly using a rotary actuator with a fixedly attached link in accordance with still another embodiment to the invention.

FIG. 8 is a partially cut-away side elevational view of a rotator assembly 34*d* having a rotary actuator 42*d* coupled to the work platform 14 and the arm bracket 38 in accordance with yet another embodiment of the invention. The rotator assembly 34*d* includes an upper link 230*a* pivotably coupled to an endcap 82*d* of the rotary actuator 42*d* (in a manner generally similar to that discussed above with reference to FIG. 7) and pivotably coupled to the work platform 14 at the upper pivot joint 52*a*. A lower link 230*b* is fixedly and rigidly coupled to an attachment flange portion 78*d* of the shaft 74*d* of the rotary actuator 42*d* with bolts 160 and is pivotably coupled to the work platform 14 at the lower pivot joint 52*b*. As such, the lower link 230*b* is non-pivotally attached to prevent pivoted movement in the vertical direction. A platform bracket 50*d* is fixedly attached to the rear portion of the work platform 14 and has a relatively stiff support bar 118*a* that extends over the lower link 230*b*. The support bar 118*a* is attached to the lower link 230*b* with a bolt 162 and a nut 164 to resist downward motion of the work platform 14 relative to the rotary actuator 42*d*. In one embodiment, the bolt 162 and the nut 164 can be tightened to draw the lower link 230*b* toward the support bar 118*a*, pre-loading the lower link and/or resisting the likelihood for the work platform 14 to bounce during transit, as was discussed above with reference to FIG. 5. The support bar 118*a* can also include a stop bolt 166 and nut 168 to adjust the maximum deflection (under load) of the work platform 14 relative to the lower link 230*b* and the rotary actuator 42*d*.

In one aspect of the embodiment shown in FIG. 8, the lower link 230*b* is rigid enough to support the load of the work platform 14 and transfer that load to the shaft 74*d* of the rotary actuator 42*d*, but is at least somewhat flexible and resilient so that it bends very slightly as the load supported by the work platform 14 increases. Accordingly, the lower link 230*b* can include a strain gauge 60*d* or other device to detect deformation or deflection of the lower link 230*b* under load. The strain gauge 60*d* can be coupled to a signal processor to generate a warning signal and/or a shut down signal, generally as was discussed above with reference to FIG. 7.

Figure 9:
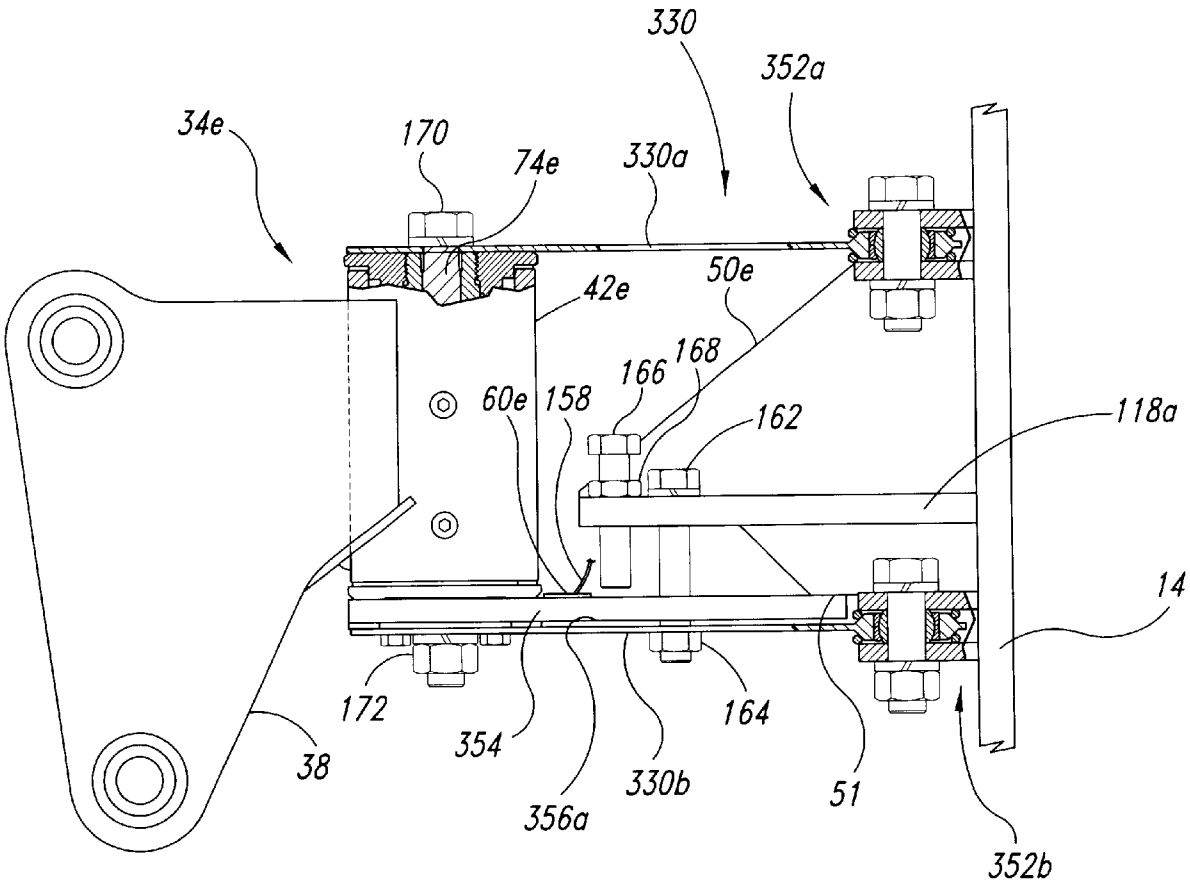
FIG. 9 is a partially cut-away side elevational view of a work platform assembly using a rotary actuator with a pair of fixedly attached links in accordance with still another embodiment of the invention.

FIG. 9 is a partially cut-away side elevational view of a rotator assembly 34*e* having a rotary actuator 42*e* coupled between the work platform 14 and the arm bracket 38 in accordance with yet another embodiment to the invention. The rotator assembly 34*e* has links 330, including an upper link 330*a* and a lower link 330*b*, each fixedly coupled to the shaft 74*e* of the rotary actuator 42*e* with a bolt 170 and a nut 172. The bolt 170 passes through an axially extending opening extending fully through the shaft 74*e*. The upper link 330*a* is coupled to the work platform 14 with an upper spherical pivot joint 352*a* and the lower link 330*b* is coupled to the work platform with a lower spherical pivot joint 352*b*. Alternatively, the links 330 can be rigidly attached to the work platform 14. In either embodiment, the upper link 330*a* and the lower link 330*b* are flexible to allow the work platform 14 to swing downward slightly relative to the rotary actuator 42*e* when the work platform is under load. The upper and lower links 330 and 330*b* also transmit rotary motion from the rotary actuator 42*e* to the work platform 14 in a manner generally similar to that discussed above.

A bracket 50*e* extends rearwardly from the rear of the support platform 14 and is attached to the support bar 118*a* which extends over the lower link 330*b*. A spring bar 354 is rigidly attached to and extends from the shaft 74*e* toward the work platform 14 to engage a lower edge 51 of the bracket 50*e*. Accordingly, vertical loads are transmitted from the work platform 14 to the rotary actuator 42*e* and the arm bracket 38 via the bracket 50*e* and the spring bar 354. The spring bar 354 can include a strain gauge 60*e* or other load sensor to detect the load borne by the work platform 14 in a manner generally similar to that discussed above with reference to FIG. 7. While the upper and lower links 330 transmit some load of the work platform 14 to the shaft 74*e*, they have much greater flexibility than spring bar 354 and hence the primary transfer of the load of the work platform is transmitted to the shaft by the spring bar. The vertical travel of the work platform 14 can be limited by adjusting the stop bolt 166, and the spring bar 354 can be pre-loaded by tightening the bolt 162 and the nut 164 coupled between the support bar 118*a,* the spring bar 354 and the lower link 330*b.*

Figure 10:
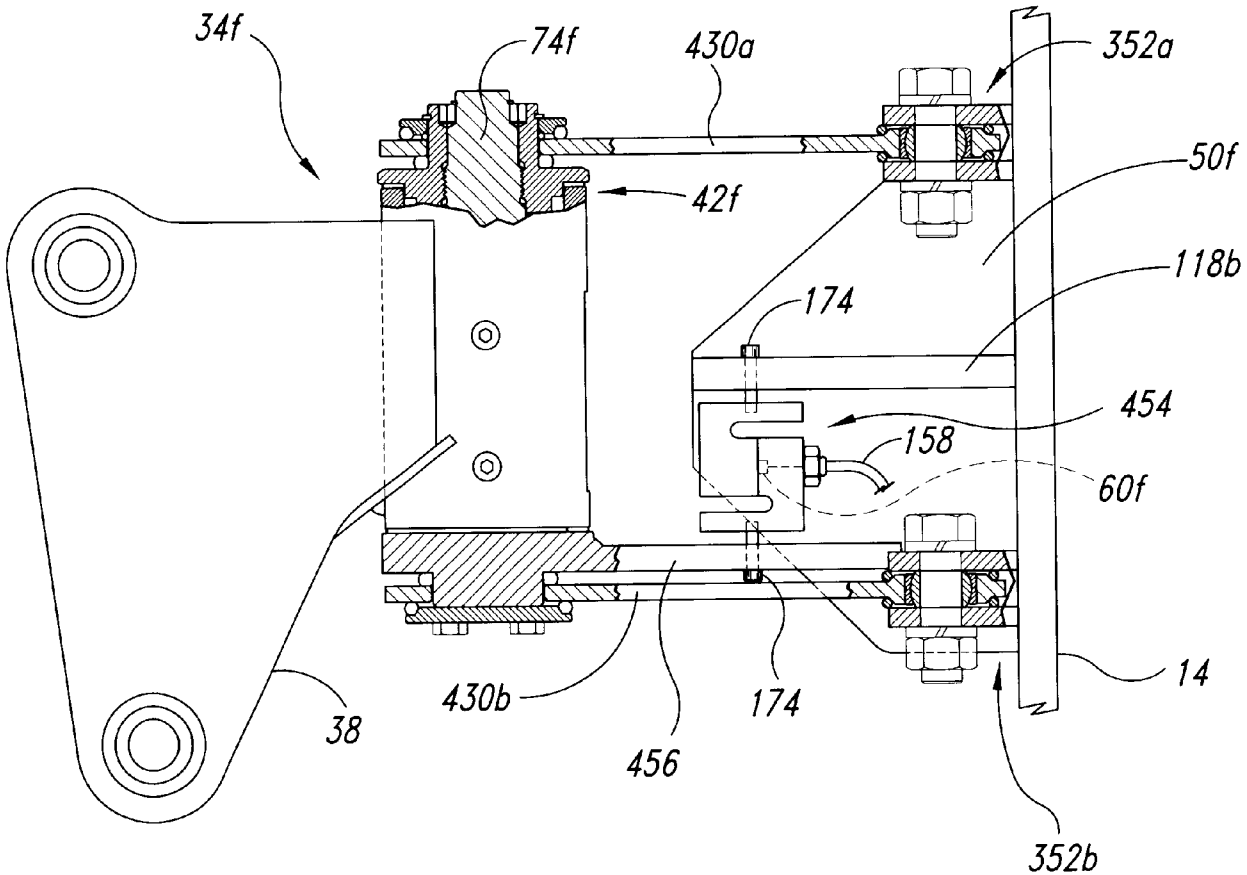
FIG. 10 is partially cut-away side elevational view of a work platform assembly using a rotary actuator with two links and a strain gaged spring in accordance with still another embodiment of the invention.

FIG. 10 is a partially cut-away side elevational view of a rotator assembly 34*f* having a rotary actuator 42*f* coupled between the work platform 14 and the arm bracket 38 in accordance with still another embodiment of the invention. The rotary actuator 34*f* includes an upper link 430*a* and a lower link 430*b,* each rotatably coupled to the shaft 74*f* of the rotary actuator 42*f* in a manner generally similar to that discussed above with reference to FIG. 7. The links 430*a,* 430*b* are rotatably coupled to the work platform 14 at an upper pivot joint 352*a* and a lower pivot joint 352*b,* respectively, in a manner generally similar to that discussed above with reference FIG. 9. The rotator assembly 34*f* further includes a rotating arm 456, fixedly connected to the shaft 74*f* to rotate with the shaft, and extending toward the work platform 14 between two flanges 50*f,* one of which is visible in FIG. 10. The sides of the arm 456 engage the faces of the flanges 50*f* to transmit rotational motion from the shaft 74*f* to the work platform 14. The load of the work platform 14 is transmitted to the shaft 74*f* almost completely by the arm 456, and hence the arm 456 primarily support the work platform against downward movement under a load in the downward direction.

The work platform 14 further includes a spring support 118*b* extending rearwardly from the rear surface of the work platform over the arm 456. An S-shaped spring 454 is coupled between the rotary arm 456 and the spring support 118*b* with bolts 174 to resist downward motion of the work platform 14 relative to the rotary actuator 42*f*. In one aspect of this embodiment, the S-shaped spring 454 has an aperture in which is positioned a strain gauge 60*f* for measuring the strain and/or deformation of the spring 454 as the work platform 14 is loaded.

Figure 11A:
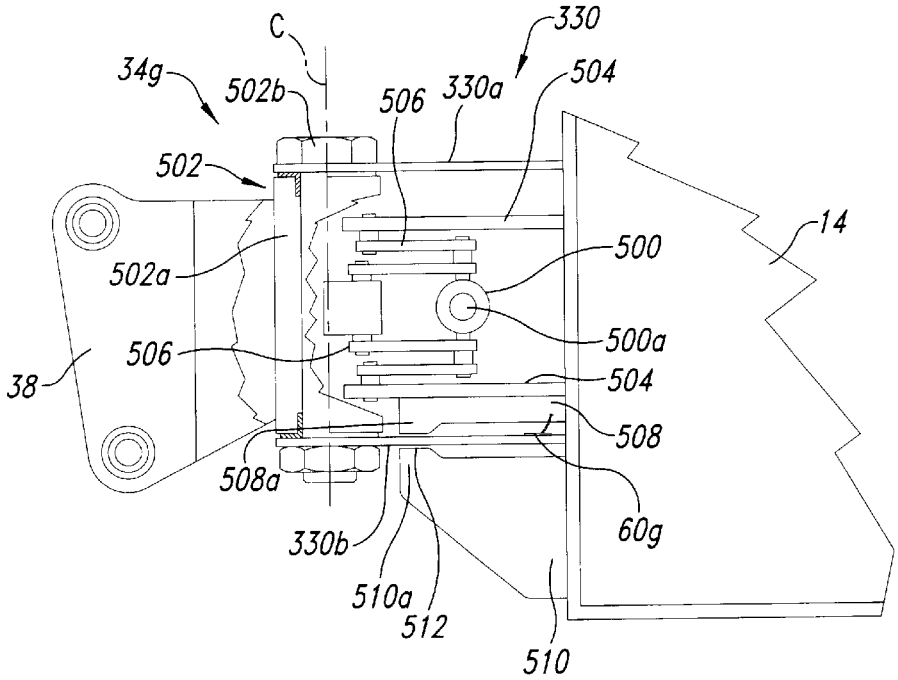
FIG. 11A is a partial cut-away side elevational view of a work platform assembly using a hydraulic actuator with two plate links in accordance with yet another embodiment of the invention.
Figure 11B:
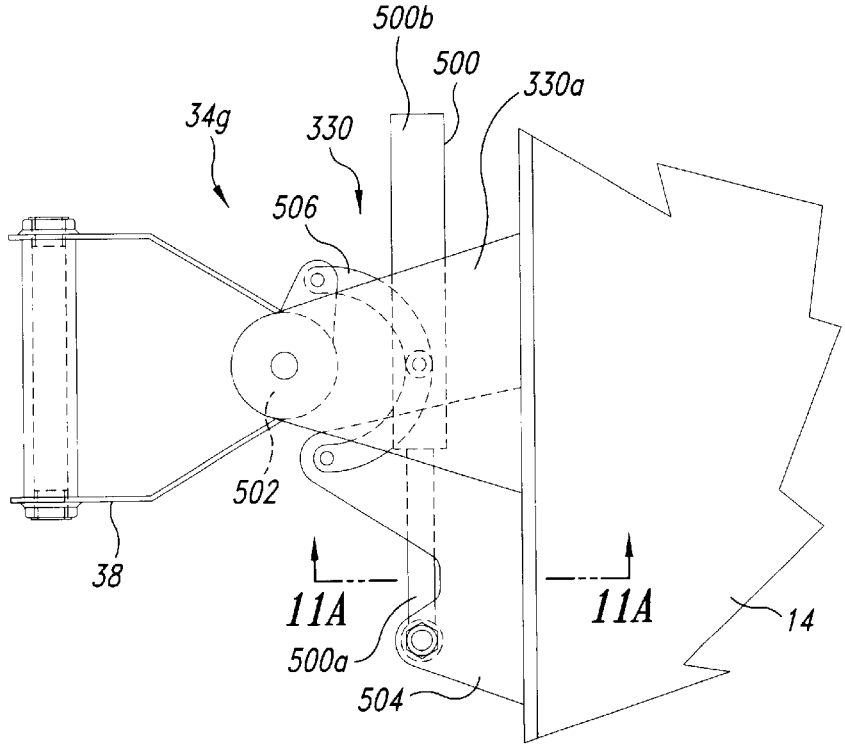
FIG. 11B is a top plan view of the work platform assembly of FIG. 11A taken substantially along the lines 11A—11A.

FIGS. 11A and 11B show a rotator assembly 34*g* operated by a telescopically extensible hydraulic cylinder 500. Much like in the embodiment of FIG. 9, the embodiment of FIGS. 11A and 11B has links 330, including an upper plate link 330*a* and a lower plate link 330*b,* each having a generally triangular plate shape with an apex portion thereof pivotally coupled through a pivot joint 502 to the arm bracket 38, which is attachable to the arm 30 of the vehicle 12. As with the rotary actuator 42 of prior embodiments, the pivot joint 502 rotates the work platform about a longitudinal axis C—C. The pivot joint 502 has a stationary member 502*a* rigidly attached to the arm bracket 38. A rotating member 502*b* is rotatably disposed within the stationary member 502*a*. The wide ends of the triangular plate links 330*a* and 330*b* are rigidly attached to the work platform 14 by welds or other manners of attachment. The apex end of the triangular plate links 330*a* and 330*b* are rigidly attached to the rotating member 502*b* of the pivot joint 502 to permit the free clockwise and counterclockwise rotation of the work platform 14 relative to the arm bracket 38 and hence the vehicle 12. The hydraulic cylinder 500 has an extensible arm 500*a* pivotally coupled between a pair of mounting brackets 504 fixedly attached to the work platform 14 and has its cylinder portion 500*b* connected through a pair of progressive link connectors 506 to the pivot joint 502 and the mounting plates 504 such that extension and retraction of the arm 500*a* of the hydraulic cylinder 500 causes the work platform 14 to rotate clockwise and counterclockwise about the longitudinal axis C—C of the pivot joint 502.

Much as in the embodiment of FIG. 9, the upper plate link 330*a* and the lower plate link 330*b* are manufactured from a sufficiently flexible and resilient spring plate to flex downward somewhat under the load applied in the downward direction to the work platform 14, but yet rigid enough to support the load of the work platform and transfer that load to the pivot joint 502. In the illustrated embodiment the upper and lower plate links 330*a* and 330*b* are of the same thickness and are sufficiently thin to bend or flex under load along a substantial portion of their length. The flexure is not inhibited by use of gussets or other members that prevent bending. A strain gauge 60*g,* or other load sensor or motion sensor, is mounted to the lower plate link 330*b* to detect the load borne by the work platform 14 that is transmitted to the pivot joint 502 through the lower plate link 330*b*. In the alternative or in addition thereto, a strain gauge may be mounted to the upper plate link 330*a*.

An upper bracket 508 and a lower bracket 510 extend rearwardly from the rear of the sport platform 14 and are rigidly attached to the support platform 14. The upper and lower brackets 508 and 510 are in a coplanar arrangement in a plane extending generally transverse to a horizontal plane within which the triangular plate comprising the lower plate link 330*b* lies. Each of the brackets 508 and 510 has a rearward end portion thereof 508*a* and 510*a,* respectively, located adjacent to the pivot joint 502 and spaced apart to define a gap 512 therebetween. The lower plate link 330*b* passes through the gap 512. The gap 512 is sized sufficiently large to permit a desired flexure of the lower plate link 330*b* under a load for which the vehicle 12 has been rated applied to the work platform 14 in the downward direction. In the event that the flexure of the lower plate link 330*b* exceeds a desired amount, the rearward portion 508*a* of the upper bracket 508 will engage the upper surface of the lower plate link 330*b* and prevent further downward movement of the work platform 14. In a similar manner, if a sufficient upward force is applied to the work platform 14, the rearward portion 510*a* of the lower bracket 510 will engage the lower surface of the lower plate link 330*b* and prevent further upward travel of the work platform 14. The upper and lower brackets 508 and 510 serve to transmit overloads on the work platform 14 in the vertical direction, both upward and downward, more directly to the pivot joint 502 without passing the overload through the full length of the lower plate link 330*b*.

While the upper and lower plate links 330*a* and 330*b* have been described as having a triangular shape, other shapes can be utilized so long as they provide sufficient rigidity and strength to support the load on the work platform 14 but yet provide adequate flexibility and resiliency. The flexibility is particularly necessary when sensing the load using a motion sensor rather than a strain sensor, but so long as the sensor can sense the load on the one of the upper or lower plate links to which it is attached, so as to indicate the relative loading of the work platform, the requirement for flexibility is diminished.

Figure 12A:
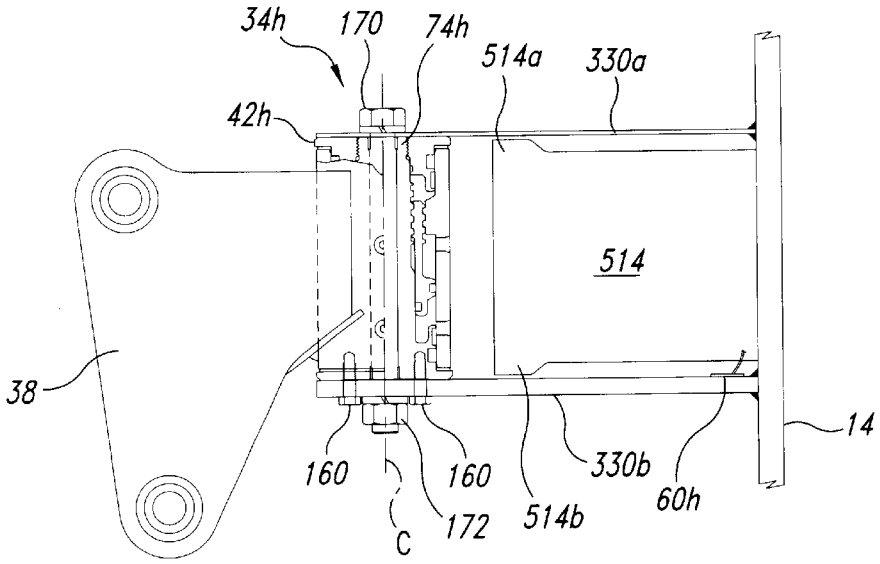
FIG. 12A is a partial cut-away side elevational view of a work platform assembly using a rotary actuator with two plate links in accordance with another embodiment of the invention.
Figure 12B:
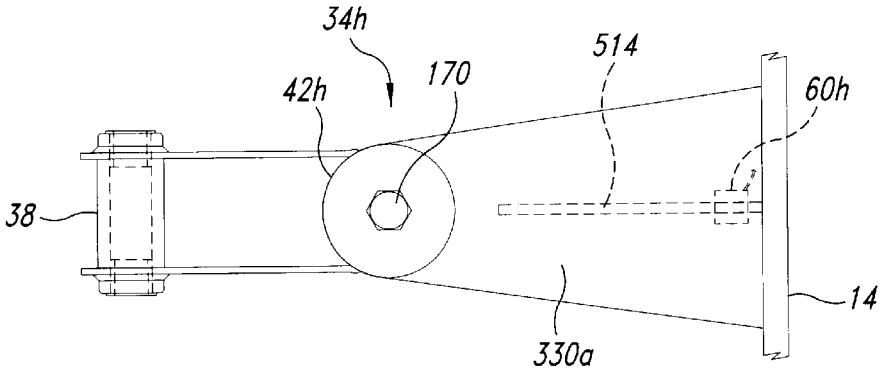
FIG. 12B is a top plan view of the work platform assembly of FIG. 12A.
Figure 12C:
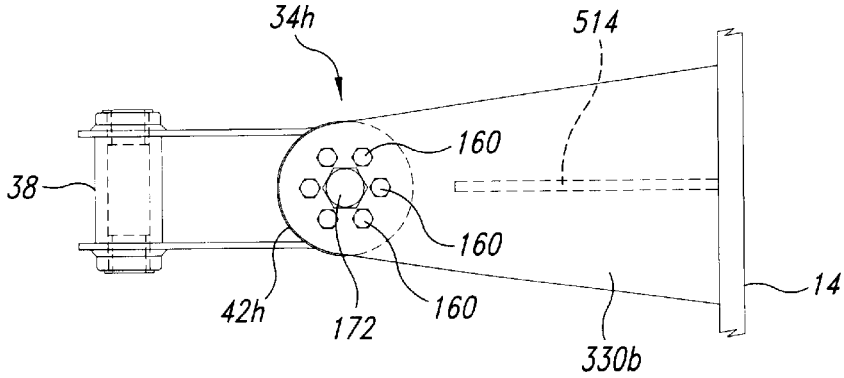
FIG. 12C is a bottom plan view of the work platform assembly of FIG. 12A.

Another embodiment of the invention is shown in FIGS. 12A, 12B and 12C. In this embodiment, a rotary assembly 34*h* includes a rotary actuator 42*h* coupled between the work platform 14 and the arm bracket 38 using links 330, much as used in the embodiment of FIGS. 11A and 11B. The links 330 include the upper plate link 330*a* and the lower plate link 330*b* both having a triangular shape with the apex portion rigidly coupled to the shaft 74*h* of the rotary actuator 42*h* by the bolt 170, as is done in the embodiment of FIG. 9, and also by bolts 160 as used in the embodiment of FIG. 8, to ensure that the links 330 rotate with the shaft 74*h* and transmit the rotary drive of the rotary actuator 42*h* to the work platform 14 and deliver sufficient rotational force to rotate the work platform when it is carrying a load.

As with the embodiment of FIGS. 11A and B, the wide ends of the triangular plates used for the upper and lower plate links 330*a* and 330*b* are rigidly attached to the work platform 14. The upper and lower plate links 330*a* and 330*b* are sufficiently flexible and resilient to allow the work platform 14 to swing downward slightly relative to the rotary actuator 42*h* when the work platform is under load. However, in this embodiment, the lower plate link 330*b* has a greater thickness than the upper plate link 330*a* and hence provides greater support for the work platform and transmits the primary portion of the load on the work platform 14 to the rotary actuator 42*h*. Nevertheless, the lower plate link 330*b* still has sufficient flexibility and resiliency to allow the work platform 14 to swing downward slightly relative to the rotary actuator 42*h* when the work platform is under load.

The upper and lower plate links 330*a* and 330*b* must have sufficient strength in the lateral direction to transmit the rotary motion of the rotary actuator 42*h* to the work platform 14 in a manner generally similar to that discussed above for other embodiments. A strain gauge 60, or other load or motion sensor, is attached to the lower plate link 330*b* to detect the load borne by the work platform 14 in a manner generally similar to that discussed above.

In the embodiment of FIGS. 12A–12C, a single bracket 514 is positioned between the upper and lower plate links 330*a* and 330*b*, and is rigidly attached to the rear of the support platform 14 and extends rearwardly therefrom. As with the brackets 508 and 510 of the embodiment of FIGS. 11A and 11B, the bracket 514 of this embodiment serves to transmit overloads in the vertical direction from the work platform 14 to the upper and lower plate links 330*a* and 330*b*, at a location close to the rotary actuator 42*h*. In particular, the bracket 514 is a plate oriented in a plane transverse to the triangular plates of the upper and lower plate links 330*a* and 330*b*, and has rearward upper and lower engagement portions 514*a* and 514*b* which are positioned in spaced apart arrangement from the lower side of the upper plate link 330*a* and the upper side of the lower plate link 330*b*, respectively when the work platform 14 is unloaded. When a sufficiently great load in the upward or downward direction is applied to the work platform 14 movement is limited and the overload is transferred more directly to the shaft of the rotary actuator 42*h* rather than through the entire length of the plate link. The rearward engagement portion 514*a* will move upward under an upward load to engage the upper plate link 330*a* at a position close to the rotary actuator 42*h*, and the rearward engagement portion 514*b* will move downward under a downward load to engage the lower plate link 330*b* at a position close to the rotary actuator 42*h*. Thereby the excessive loads are prevented from being transmitted through the entire length of the upper and lower plate links.

Figure 13A:
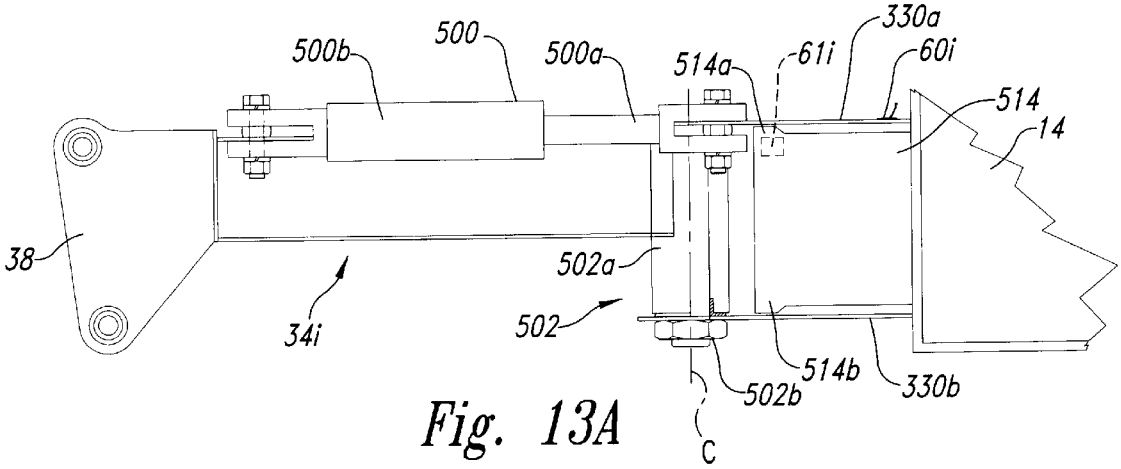
FIG. 13A is a partial cut-away side elevational view of a work platform assembly using a hydraulic actuator in accordance with another embodiment of the invention.
Figure 13B:
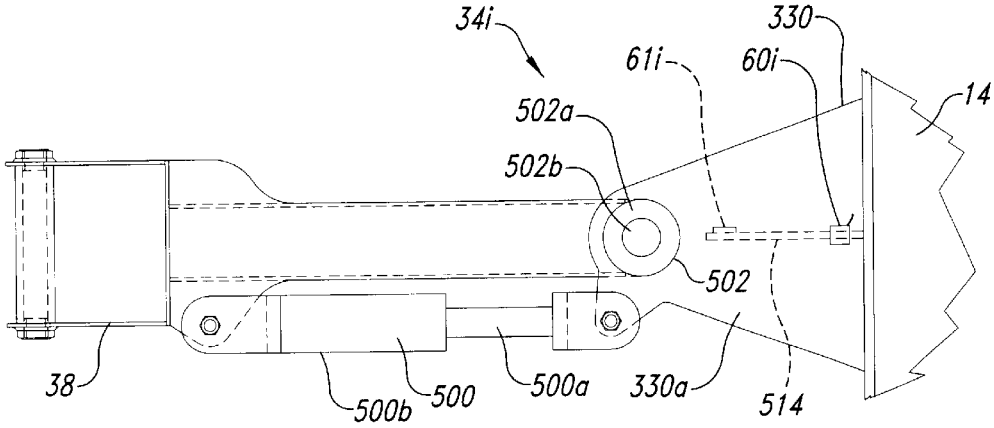
FIG. 13B is a top plan view of the work platform assembly of FIG. 13B.
Figure 13C:
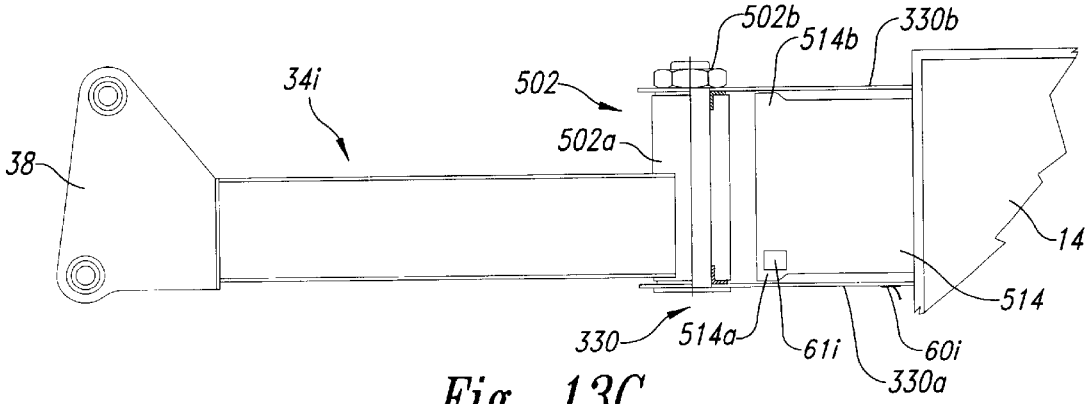
FIG. 13C is a side elevational view of the work platform assembly of FIG. 13A from an opposite side and shown rotated 180° about a horizontal axis from the view of FIG. 13A.

FIGS. 13A, 13B and 13C show a rotary assembly 34*i* which is in many ways similar to the embodiment of FIGS. 11A and 11B. The rotator assembly 34*i* utilizes a hydraulic cylinder 500 to cause rotation of the work platform 14. In this embodiment, the hydraulic cylinder 500 has its cylinder portion 500*b* pivotally connected to a flange positioned toward the arm bracket 38 and its extensible arm 500*a* pivotally attached to the upper plate link 330*a* to cause selective rotation of the work platform 14 about the pivot joint 502 when the arm 500*a* is extended and retracted.

The upper and lower plate links 330*a* and 330*b* have the same triangular shape and attachments as described for the embodiment of FIGS. 11A and 11B, and have the same resiliency and flexibility described. In this embodiment, as described above for the embodiment of FIGS. 12A–12C, the single bracket 514 is used in a position between the upper and lower plate links 330*a* and 330*b*, with upper and lower engagement portions 514*a* and 514*b*. In the embodiment of FIGS. 13A–C, however, a strain gauge 60*i*, or other load or motion sensor, used to detect the load borne by the work platform 14, is attached to the upper plate link 330*a*. An alternative motion sensor 61*i* is shown in FIGS. 13A–13C as being attached to the bracket 514.

Figure 14A:
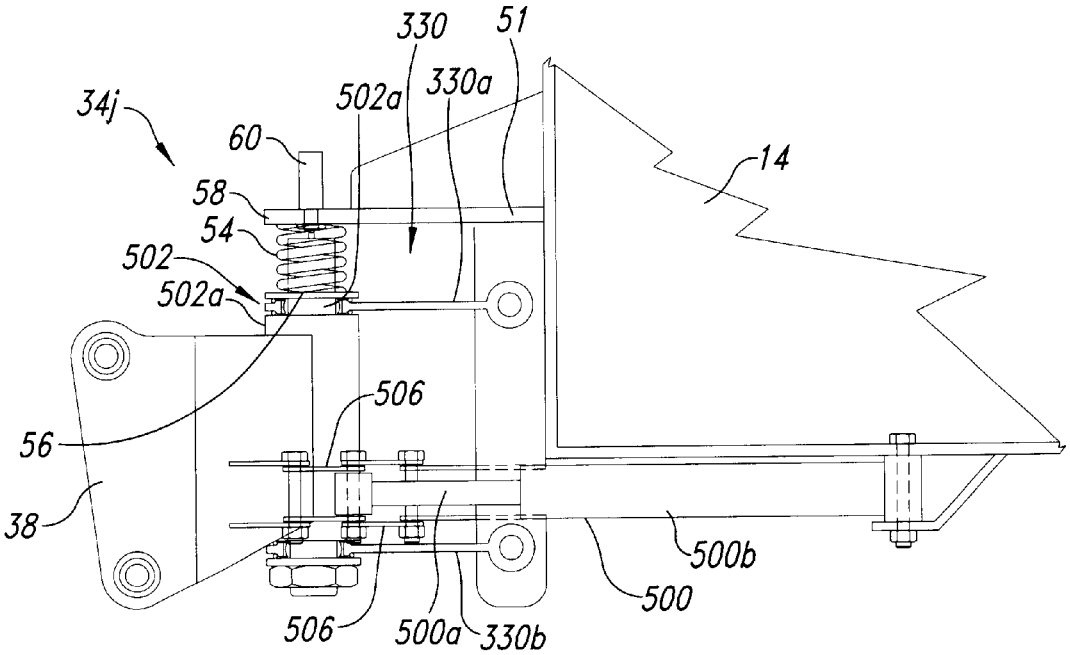
FIG. 14A is a partial cut-away side elevational view of a work platform assembly using a hydraulic actuator in accordance with yet another embodiment of the invention.
Figure 14B:
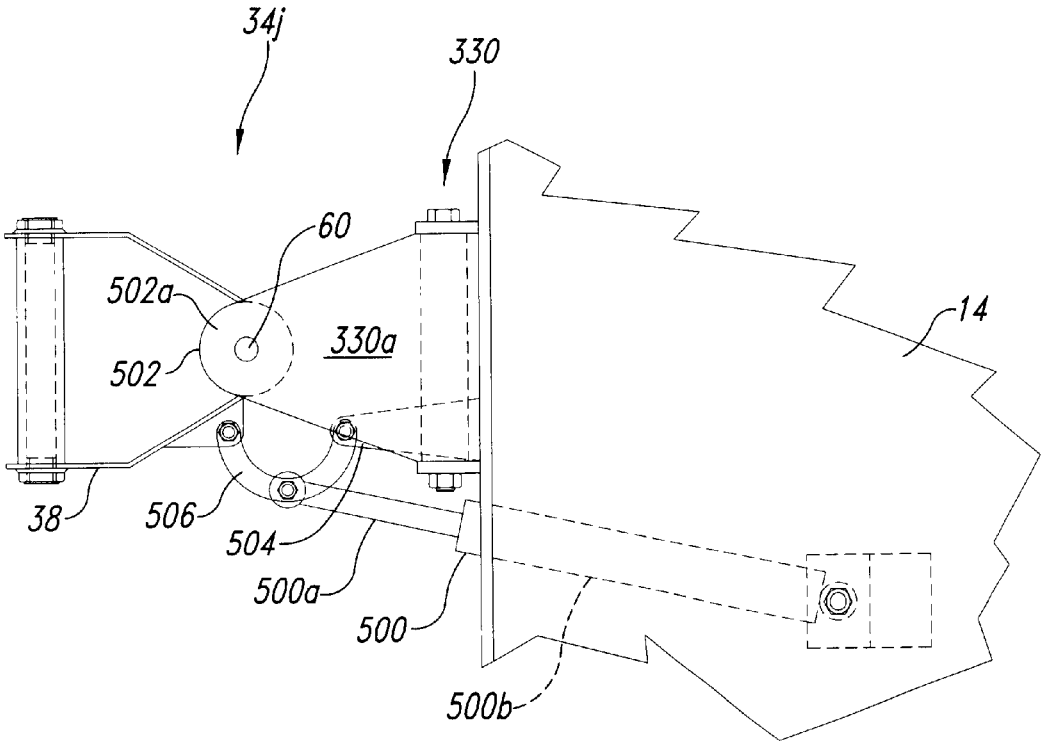
FIG. 14B is a top plan view of the work platform assembly of FIG. 14A.

In FIGS. 14A and 14B, a rotor assembly 34*j*, using a hydraulic cylinder 500 much as described above for the embodiment of FIGS. 11A and 11B, is coupled between the work platform 14 and the arm bracket 38. In this embodiment, the upper and lower plate links 330*a* and 330*b* have spherical bushings at an end thereof which is connected to the pivot joint 502 and have opposite ends pivotally attached to the work platform 14. In this embodiment, the upper and lower plate links permit movement of the work platform 14 in the downward direction under a load, and return movement upon unloading, but restrict movement in directions out of alignment with the load direction except for rotation of the work platform in the rotational plane in response to operation of the hydraulic actuator 500. Since the upper and lower plate links 330*a* and 330*b* are pivotally attached to both the pivot joint 502 and the work platform 14, downward loading of the work platform is transmitted to the pivot joint 502 through a rearwardly extending load transfer arm 51 which is rigidly attached to the work platform 14, much as described with respect to the embodiment of FIG. 3. The load transfer arm 51 has a spring engaging portion 58 which engages a spring 54. The spring 54 is positioned between the spring engaging portion 58 and a spring support 56 positioned above the rotatable portion 502*b* of the pivot joint 502. A sensor 60, in the form of a switch, is attached to sense vertical motion of the work platform 14 relative to the rotary joint 502.

In the embodiments discussed with reference to the Figures, the link or links, the rotary arm 456, or other member or members, provided between the work platform 14 and the rotary actuator 42 allow the rotary motion of the drive shaft 74 to be transmitted to the work platform and enables all or nearly all other loads, movements, torques, horizontal forces and the like to be transmitted to the rotary actuator in a manner which does not significantly affect the measuring of the vertical load by the load sensor. In effect, the load sensor is substantially isolated from all but the vertical load. Accordingly, the strain gauge switch or other load sensing device is able to measure the vertical load accurately and consistently. Alternatively, the load sensor and the link between the rotary actuator 42 and the work platform 14 can be configured to isolate loads in directions other than the vertical direction. In any embodiment, an advantage of this arrangement is that only a selected component of the load borne by the work platform 14 is transmitted to the load sensor, so that the load sensor more accurately determines the load in the selected direction.

From the foregoing it will be appreciated that, although specific embodiments of the invention have been described herein for purposes of illustration, various modifications may be made without deviating from the spirit and scope of the invention. For example, the work platform and rotator assembly can be coupled to vehicles other than the one shown in FIG. 1, such as utility trucks and the like. Alternatively, the vehicle can include a fork lift and the work platform can include forks coupled to forklift with a rotary actuator in a manner generally similar to that discussed above with reference to Figures. Accordingly, the work platform discussed above with reference to Figures can include any load support member configured to support a load. Further, the output shaft of the rotary actuator can be coupled to the arm of the vehicle and the body of the rotary actuator can be coupled to the work platform to provide for relative lateral rotation of the work platform relative to the arm. The spring can be a coil spring, a cantilever member or other types of spring devices that support the work platform and deflect or deformat as the load applied to the platform changes. Accordingly, the invention is not limited except as by the appended claims.

What is claimed is:

1. A fluid-powered laterally rotatable work platform assembly useable with a vehicle having an arm for positioning the work platform assembly, the work platform assembly comprising:

a work platform having a support surface for supporting a load;

a body having a first end, a second end, a longitudinal axis extending between the first and second ends and a cavity extending along the longitudinal axis at least part way between the first and second ends, the body having a body connection portion configured to be coupled to one of the work platform and the arm of the vehicle;

an output shaft rotatably disposed within the body and having a shaft axis generally coaxial with the longitudinal axis of the body, the shaft having a shaft connection portion configured to be coupled to the other of the work platform and the arm of the vehicle;

a linear-to-rotary force transmitting member positioned within the cavity of the body and mounted for longitudinal movement within the body generally aligned with the longitudinal axis in response to selective application of pressurized fluid thereto, the force transmitting member engaging the body and the output shaft to translate longitudinal motion of the force transmitting member to rotational movement of one of the output shaft and the body relative to the other of the output shaft and the body;

at least one link member coupled between the work platform and the one of the body and output shaft connection portions to which the work platform is coupled, the at least one link member being coupled to transmit rotational force to the work platform to selectively laterally rotate in a lateral plane the work platform about the longitudinal axis to the left and to the right relative to the arm of the vehicle as one of the output shaft and the body rotates relative to the other, the at least one link member having sufficient strength to support the work platform above the ground while the work platform supports the load when the load is below a selected load capacity in a downward direction while permitting at least limited downward movement of the work platform under the load supported by the work platform in the downward direction at least when the load in the downward direction approaches the selected load capacity, the at least one link member being configured to transmit at least a portion of the load supported by the work platform in the downward direction to the one of the body and output shaft connection portions to which the work platform is coupled by the at least one link member, the at least one link member being sufficiently flexible to flex downward under the portion of the load supported by the work platform in the downward direction which is transmitted by the at least one link member when the load supported by the work platform in the downward direction approaches the selected load capacity; and at least one load sensor positioned to detect the portion of the load supported by the work platform in the downward direction which is transmitted by the at least one link member by measuring the flexure of the at least one link member in the downward direction.

2. The assembly of claim 1, wherein said at least one load sensor is configured to trigger a warning signal when the portion of the load in the downward direction supported by the work platform which is transmitted by the at least one link member exceeds a first selected value corresponding to the work platform moving downward to a first lowered position relative to the one of the body and output shaft connection portion configured to be coupled to the arm of the vehicle, the load sensor being configured to trigger a signal halting motion of the work platform when the portion of the load in the downward direction supported by the work platform which is transmitted by the at least one link member exceeds a second value greater than the first value corresponding to the work platform moving downward to a second lowered position lower than the first lowered position.

3. The assembly of claim 1 wherein the at least one load sensor is a strain gauge.

4. A fluid-powered rotatable support member assembly usable with an assembly support platform configured to position the support member assembly, the support member assembly comprising;

a load support member having a support surface for supporting a load;

a body having a first end, a second end, a longitudinal axis extending between the first and second ends and a cavity extending along the longitudinal axis at least part way between the first and second ends;

a shaft rotatably disposed within the body and having a shaft axis generally aligned with the longitudinal axis of the body, one of the body and the shaft configured to be coupled to the assembly support platform and the other one of the body and the shaft being configured to provide a rotary drive to the load support member;

a linear-to-rotary force transmitting member positioned within the cavity of the body and mounted for longitudinal movement within the body generally aligned with the longitudinal axis in response to selective application of pressurized fluid thereto, the force transmitting member engaging the body and the shaft to translate longitudinal motion of the force transmitting member to rotational movement between the shaft and the body with a rotational force sufficient to selectively rotate the load support member relative to the assembly support platform in a lateral rotational plane;

at least one link member coupled between the load support member and the other one of the body and the shaft, the at least one link member being coupled to transmit the rotary drive of the other one of the body and the shaft to the load support member to selectively rotate the load support member about the longitudinal axis relative to the assembly support platform in the rotational plane as one of the shaft and the body rotates relative to the other, and to permit movement of the load support member in a selected direction out of alignment with the rotational plane while restricting movement in directions out of alignment with the selected direction except rotation of the load support member in the rotational plane in response to the rotary drive transmitted thereto by the at least one link member;

a load transfer member coupled between the load support member and the other one of the body and the shaft to transmit at least a portion of the load supported by the load support member in the selected direction to the other one of the body and the shaft and thereby support the load support member against movement in the selected direction, the load transfer member being a first flexible plate member having a planar portion arranged substantially parallel to the rotational plane, the first plate member having sufficient strength to support the load support member above the ground while the support surface supports the load when the load is below a selected load capacity in the selected direction while permitting at least limited movement of the load support member in the selected direction under the load supported by the support surface in the selected direction at least when the load in the selected direction approaches the selected load capacity, the planar portion of the first plate member being sufficiently flexible to flex in the selected direction under the portion of the load supported by the support surface in the selected direction which is transmitted by the first plate member when the load supported by the support surface in the selected direction approaches the selected load capacity; and a load sensor positioned to detect the portion of the load supported by the load support member in the selected direction which is transmitted by the load transfer member between the load support member and the other one of the body and the shaft by detecting flexure of the planar portion of the first plate member in the selected direction under the loading of the portion of the load supported by the load support member in the selected direction which is transmitted by the first plate member between the load support member and the other one of the body and shaft.

5. The assembly of claim 4 wherein the first plate member is rigidly attached to the load support member and to the other one of the body and the shaft, and the planar portion of the first plate member is flexible and resilient to allow resilient flexure in the selected direction.

6. The assembly of claim 5 wherein the load sensor includes one of a strain gauge and a switch.

7. The assembly of claim 4 wherein the first plate member is rigidly attached to the other one of the body and the shaft, and the planar portion of the first plate member is sufficiently flexible to permit at least limited movement of the load support member in the selected direction under the load supported by the load support member in the selected direction.

8. The assembly of claim 4 wherein the at least one link member is a second flexible plate member rigidly attached to the load support member and to the other one of the body and the shaft, and sufficiently flexible and resilient to allow resilient flexure in the selected direction.

9. The assembly of claim 8 wherein the first plate member is rigidly attached to the load support member, and the planar portion of the first plate member is sufficiently flexible to permit at least limited movement of the load support member in the selected direction under the load supported by the load support member in the selected direction.

10. The assembly of claim 8 wherein the at least one link member is pivotably attached to the load support member.

11. The assembly of claim 9 wherein the first plate member is rigidly attached to the load support member.

12. The assembly of claim 3 wherein the load transfer member is rigidly attached to the load support member.

13. The assembly of claim 12 wherein the planar portion of the first plate member is flexible and resilient to allow resilient flexure in the selected direction.

14. The assembly of claim 12 wherein the load sensor includes a strain gauge attached to the load transfer member.

15. The assembly of claim 3 wherein the load transfer member is rigidly attached to the other one of the body and shaft.

16. The assembly of claim 15 wherein the at least one link member is coupled between the shaft and the load support member, and the body is coupled to the assembly support platform.

17. The assembly of claim 4 wherein the load sensor detects the flexure of the planar portion of the first plate member by detecting the spatial movement of the first plate member in the selected direction.

18. The assembly of claim 4 wherein the load sensor is a strain gauge and detects the flexure of the planar portion of the first plate member by detecting the strain on the first plate member.

19. The assembly of claim 4 wherein the selected direction is the downward direction.

20. The assembly of claim 4 wherein the at least one link member is a second flexible plate member having a planar portion arrange substantially parallel to the planar portion of the first plate member, the second plate member having sufficient strength in combination with the first plate member to support the load support member above the ground while the support surface supports the load when the load is below the selected load capacity in the selected direction while permitting at least limited movement of the support member in the selected direction under the load supported by the support surface in the selected direction at least when the load in the selected direction approaches the selected load capacity, the second plate member being sufficiently flexible to flex in the selected direction under the portion of the load supported by the support surface in the selected direction which is transmitted by the second plate member when the load supported by the support surface in the selected direction approaches the selected load capacity.

21. A fluid-powered rotatable support member assembly usable with an assembly support platform configured to position the support member assembly, the support member assembly comprising;

a load support member having a support surface for supporting a load;

a body having a first end, a second end, a longitudinal axis extending between the first and second ends and a cavity extending along the longitudinal axis at least part way between the first and second ends;

a shaft rotatably disposed within the body and having a shaft axis generally aligned with the longitudinal axis of the body, one of the body and the shaft configured to be coupled to the assembly support platform and the other one of the body and the shaft being configured to provide a rotary drive to the load support member;

a linear-to-rotary force transmitting member positioned within the cavity of the body and mounted for longitudinal movement within the body generally aligned with the longitudinal axis in response to selective application of pressurized fluid thereto, the force transmitting member engaging the body and the shaft to translate longitudinal motion of the force transmitting member to rotational movement between the shaft and the body with a rotational force sufficient to selectively rotate the load support member relative to the assembly support platform in a lateral rotational plane;

a load transfer member coupled between the load support member and the other one of the body and the shaft, the load transfer member being coupled to transmit the rotary drive of the other one of the body and the shaft to the load support member to selectively rotate the load support member about the longitudinal axis relative to the assembly support platform in the rotational plane as one of the shaft and the body rotates relative to the other, and to transmit at least a portion of the load supported by the load support member to the other one of the body and shaft and thereby support the load support member against movement in a selected direction out of alignment with the rotational plane, the load transfer member having sufficient strength to support the load support member above the ground while the support surface supports the load when the load is below a selected load capacity in the selected direction, the load transfer member being sufficiently flexible in the selected direction under the portion of the load supported by the load support member in the selected direction which is transmitted by the load transfer member between the load support member and the other one of the body and the shaft to permit at least limited movement of the load support member in the selected direction under the load supported by the support surface in the selected direction at least when the load in the selected direction approaches the selected load capacity and substantially inflexible in a direction parallel to the rotational plane;

at least one link member coupled between the load support member and the other one of the body and the shaft, the at least one link member being coupled to permit movement of the load support member in the selected direction while restricting movement in directions out of alignment with the selected direction except rotation of the load support member in the rotational plane in response to the rotary drive transmitted thereto by the load transfer member; and a load sensor positioned to detect flexure of the load transfer member in the selected direction under the loading of the portion of the load supported by the load support member in the selected direction which is transmitted by the load transfer member between the load support member and the other one of the body and the shaft.

22. The assembly of claim 21 wherein the load transfer member is rigidly attached to the load support member and to the other one of the body and the shaft.

23. The assembly of claim 21 wherein the load sensor detects the flexure of the load transfer member by detecting the spatial movement of the load transfer member in the selected direction.

24. The assembly of claim 21 wherein the load sensor is a strain gauge and detects the flexure of the load transfer member by detecting the strain on the load transfer member.

25. A fluid-powered laterally rotatable work platform assembly usable with a vehicle having an arm for positioning the work platform assembly, the work platform assembly comprising;

a load support member having a support platform surface for supporting a load;

a body having a first end, a second end, a longitudinal axis extending between the first and second ends and a cavity extending along the longitudinal axis at least part way between the first and second ends;

a shaft rotatably disposed within the body and having a shaft axis generally aligned with the longitudinal axis of the body, one of the body and the shaft configured to be coupled to the arm and the other one of the body and the shaft being configured to provide a rotary drive to the load support member;

a linear-to-rotary force transmitting member positioned within the cavity of the body and mounted for longitudinal movement within the body generally aligned with the longitudinal axis in response to selective application of pressurized fluid thereto, the force transmitting member engaging the body and the shaft to translate longitudinal motion of the force transmitting member to rotational movement between the shaft and the body with a rotational force sufficient to selectively rotate the load support member relative to the arm in a lateral rotational plane;

at least one link member coupled between the load support member and the other one of the body and the shaft, the at least one link member being coupled to transmit the rotary drive of the other of the body and the shaft to the load support member to selectively rotate the load support member about the longitudinal axis relative to the arm in the rotational plane as one of the shaft and the body rotates relative to the other, and to permit movement of the load support member in a selected direction out of alignment with the rotational plane while restricting movement in directions out of alignment with the selected direction except rotation of the load support member in the rotational plane in response to the rotary drive transmitted thereto by the at least one link member, the at least one link member being configured to transmit at least a portion of the load supported by the load support member in the selected direction to the other one of the body and shaft, the at least one link member being a plate with a lateral planar arrangement transverse to the selected direction, the plate being rigidly attached to at least one of the load support member and the other one of the body and the shaft, and having a strength sufficient to support the load support member above the ground while the load support member supports the load when the load is below a selected load capacity in the selected direction while permitting at least limited movement of the load support member in the selected direction under the load supported by the load support member in the selected direction at least when the load in the selected direction approaches the selected load capacity, the plate being sufficiently flexible and resilient to allow resilient flexure in the selected direction under the portion of the load in the selected direction supported by the load support member which is transmitted by the plate between the load support member and the other one of the body and the shaft; and a load sensor positioned to detect the portion of the load in the selected direction supported by the load support member which is transmitted by the plate between the load support member and the other one of the body and the shaft by measuring the flexure of the plate in the selected direction.

26. The assembly of claim 25 wherein the plate is rigidly attached to the load support member and to the other one of the body and the shaft, and the load sensor includes a strain gauge attached to the plate.

27. The assembly of claim 25 wherein the plate has a first end portion rigidly attached to the load support member, and a second end portion rigidly attached to the other one of the body and the shaft, and wherein the load sensor is positioned to detect the portion of the load in the selected direction supported by the load support member which is transmitted by the plate by measuring the load at a location between the first and second end portions of the plate.

28. The assembly of claim 27 wherein the plate is flexible and resilient to allow resilient flexure in the selected direction while supporting the portion of the load in the selected direction supported by the load support member which is transmitted by the plate.

29. The assembly of claim 28 wherein the load sensor includes a switch actuated by flexure of the plate in the selected direction by a predetermined amount.

30. The assembly of claim 27 wherein the load sensor includes a strain gauge attached to the plate.

31. The assembly of claim 27 further comprising a second member with a first end portion fixedly attached to the load support member and a second end portion coupled to the first member at a location between the load support member and the other one of the body and the shaft.

32. The assembly of claim 25 further comprising a load transmission member coupled between the load support member and other one of the body and shaft, the load transmission member being configured to support at least another portion of the load supported by the load support member in the selected direction not supported by the plate.

33. The assembly of claim 32 wherein the at least one link member is a first plate and the load transmission member is a second plate spaced apart from the first plate, the first and second plates being in lateral planar arrangement transverse to the selected direction.

34. The assembly of claim 33 wherein the first and second plates are flexible and resilient to allow their resilient flexure in the selected direction under the portion of the load supported thereby.

35. The assembly of claim 34 wherein the load sensor includes one of a strain gauge and a switch.

36. The assembly of claim 34 wherein the first and second plates are each rigidly attached to the load support member and to the other one of the body and the shaft.

37. The assembly of claim 25 wherein the at least one link member is coupled between the shaft and the load support member, and the body is configured to be coupled to the arm.

38. A fluid-powered laterally rotatable work platform assembly usable with a vehicle having an arm for positioning the work platform assembly, the work platform assembly comprising;

a load support member having a support platform surface for supporting a load;

a body having a first end, a second end, a longitudinal axis extending between the first and second ends and a cavity extending along the longitudinal axis at least part way between the first and second ends;

a shaft rotatably disposed within the body and having a shaft axis generally aligned with the longitudinal axis of the body, one of the body and the shaft configured to be coupled to the arm and the other one of the body and the shaft being configured to provide a rotary drive to the load support member;

a linear-to-rotary force transmitting member positioned within the cavity of the body and mounted for longitudinal movement within the body generally aligned with the longitudinal axis in response to selective application of pressurized fluid thereto, the force transmitting member engaging the body and the shaft to translate longitudinal motion of the force transmitting member to rotational movement between the shaft and the body with a rotational force sufficient to selectively rotate the load support member relative to the arm in a lateral rotational plane;

a first plate member coupled between the load support member and the other one of the body and the shaft, the first plate member being configured to transmit the rotary drive of the other one of the body and the shaft to the load support member to selectively rotate the load support member about the longitudinal axis relative to the assembly support platform in the rotational plane as one of the shaft and the body rotates relative to the other;

a second plate member coupled between the load support member and the other one of the body and the shaft, the first and second plate members being configured to each transmit at least a portion of the load supported by the load support member in a load direction out of alignment with the rotational plane to the other one of the body and the shaft, the first and second plate members each being arranged spaced apart from the other with a lateral planar orientation transverse to the load direction to restrict movement of the load support member in directions out of alignment with the load direction except rotation of the load support member in the rotational plane in response to the rotary drive transmitted thereto by the first plate member, the first and second plate members together having sufficient strength to independently support the load support member above the ground while the load support member supports the load when the load is below a selected load capacity in the load direction, one of the first and second plate members comprising a flexible plate member being sufficiently flexible and resilient to allow resilient flexure in the load direction under the portion of the load in the load direction supported thereby and transmitted to the other one of the body and the shaft; and a load sensor positioned to detect the portion of the load supported by the load support member in the load direction which is transmitted by the flexible plate member between the load support member and the other one of the body and the shaft by measuring the flexure of the flexible plate member.

39. The assembly of claim 38 wherein at least the flexible firs plate member is rigidly connected to the load support member and to the other one of the body and the shaft.

40. The assembly of claim 38 wherein the first and second plate members are configured to flexibly support the portion of the load supported by the load support member in the load direction which is transmitted by the respective first and second plate members with resulting resilient flexure of the first and second plate members in the load direction.

41. A fluid-powered laterally rotatable work platform assembly usable with a vehicle having an arm for positioning the work platform assembly, the work platform assembly comprising;

a load support member having a support platform surface for supporting a load;

a body having a first end, a second end, a longitudinal axis extending between the first and second ends and a cavity extending along the longitudinal axis at least part way between the first and second ends;

a shaft rotatably disposed within the body and having a shaft axis generally aligned with the longitudinal axis of the body, one of the body and the shaft configured to be coupled to the arm and the other one of the body and the shaft being configured to provide a rotary drive to the load support member;

a linear-to-rotary force transmitting member positioned within the cavity of the body and mounted for longitudinal movement within the body generally aligned with the longitudinal axis in response to selective application of pressurized fluid thereto, the force transmitting member engaging the body and the shaft to translate longitudinal motion of the force transmitting member to rotational movement between the shaft and the body with a rotational force sufficient to selectively rotate the load support member to the right and the left relative to the arm in a lateral rotational plane;

first and second link members in spaced apart relation, the first and second link members each being coupled between the load support member and the other one of the body and the shaft, the first and second link members each having a first end portion attached to the load support member and a second end portion attached the other one of the body and the shaft, at least the first link member configured to transmit the rotary drive of the other one of the body and the shaft to the load support member to selectively rotate the load support member about the longitudinal axis to the right and the left relative to the arm in the rotational plane as one of the shaft and the body rotates relative to the other, the first and second link members configured to permit movement of the load support member in a selected direction out of alignment with the rotational plane while restricting movement in directions out of alignment with the selected direction except rotation of the load support member in the rotational plane in response to the rotary drive transmitted thereto by the first link member, the first and second link members each being arranged in a plane out of alignment with the selected direction and sufficiently flexible and resilient to permit flexure thereof in the selected direction under the load in the selected direction supported by the load support member and return movement in a direction opposite the selected direction when the load is removed, at least one of the first and second link members having sufficient strength to support the load support member above the ground while the load support member supports the load when the load is below a selected load capacity in the selected direction and sufficient rigidity to transmit at least a portion of the load in the selected direction supported by the load support member to the other one of the body and the shaft when the load supported by the load support member in the selected direction approaches the selected load capacity; and a load sensor positioned to detect the portion of the load in the selected direction supported by the load support member which is transmitted by the at least one of the first and second link members between the load support member and the other one of the body and the shaft by measuring the flexure of the at least one of the first and second link members in the selected direction.

42. The assembly of claim 41 wherein the first and second link members each are first and second plate members, respectively, in parallel planar arrangements with the plane out of alignment with the selected direction, the first and second plate members having thicknesses selected to provide the flexibility and resilience to permit flexure in the selected direction.

43. The assembly of claim 42 wherein at least one of the first and second plate members has its first end portion rigidly attached to the load support member and its second end portion rigidly attached to the other one of the body and the shaft.

44. The assembly of claim 43 wherein the at least one of the first and second plate members with its first end portion rigidly attached to the load support member is attached by a weld.

45. The assembly of claim 41 wherein the load sensor is attached to the at least one of the first and second link members to detect the portion of the load in the selected direction supported by the load support member which is transmitted by the at least one of the first and second link members between the load support member and the other of the body and the shaft.

46. The assembly of claim 45 wherein the load sensor includes a strain gauge.

47. The assembly of claim 41, further comprising an engagement member positioned toward the second end portion of the first link member at a location adjacent to the other one of the body and the shaft so as to be engaged by the first link member and limit movement thereof in the selected direction when the first link member flexes in the selected direction under the load in the selected direction supported by the load support member exceeding a selected amount.

48. The assembly of claim 47 further comprising another engagement member positioned toward the second end portion of one of the first and second link members at a location adjacent to the other one of the body and the shaft so as to be engaged by the one of the first and second link members and limit movement thereof in the direction opposite the selected direction when the one of the first and second link members flexes in the direction opposite the selected direction when a force is applied to the load support member in the direction opposite the selected direction exceeding a selected amount.

49. The assembly of claim 41 wherein the first and second link members each transmit a portion of the load in the selected direction supported by the load support member to the other one of the body and the shaft, the first link member being more rigid than the second link member to transmit a larger portion of the load in the selected direction supported by the load support member to the other one of the body and the shaft than the portion transmitted by the second link member.

50. The assembly of claim 41 wherein the first and second link members have substantially the same rigidity and thereby transmit substantially the same amount of the load supported by the load support member to the other one of the body and the shaft.

51. The assembly of claim 41 wherein the load sensor detects the portion of the load transmitted by the at least one of the first and second link members by detecting the spatial movement of the at least one of the first and second link members in the selected direction.

52. The assembly of claim 41 wherein the load sensor is a strain gauge positioned to detect the strain on the at least one of the first and second link members in the selected direction.

53. A fluid-powered rotatable support member assembly usable with an assembly support platform configured to position the support member assembly, the support member assembly comprising;

a load support member having a support surface for supporting a load;

a body having a first end, a second end, a longitudinal axis extending between the first and second ends and a cavity extending along the longitudinal axis at least part way between the first and second ends;

a shaft rotatably disposed within the body and having a shaft axis generally aligned with the longitudinal axis of the body, one of the body and the shaft configured to be coupled to the assembly support platform and the other one of the body and the shaft being configured to provide a rotary drive to the load support member;

a linear-to-rotary force transmitting member positioned within the cavity of the body and mounted for longitudinal movement within the body generally aligned with the longitudinal axis in response to selective application of pressurized fluid thereto, the force transmitting member engaging the body and the shaft to translate longitudinal motion of the force transmitting member to rotational movement between the shaft and the body with a rotational force sufficient to selectively rotate the load support member relative to the assembly support platform in a rotational plane;

first and second link members in spaced apart relation, the first and second link members each being coupled between the load support member and the other one of the body and the shaft, the first and second link members each having a first end portion attached to the load support member and a second end portion attached the other one of the body and the shaft with at least one of the first and second link members configured to transmit the rotary drive of the other one of the bode and the shaft to the load support member to selectively rotate the load support member about the longitudinal axis relative to the assembly support platform in the rotational plane as one of the shaft and the body rotates relative to the other, and with the first and second link members configured to permit movement of the load support member in a selected direction out of alignment with the rotational plane while restricting movement in directions out of alignment with the selected direction except rotation of the load support member in the rotational plane in response to the rotary drive transmitted thereto by the at least one of the first and second link members, the first and second link members each being arranged in a plane out of alignment with the selected direction and sufficiently flexible and resilient to permit flexure thereof in the selected direction under the load supported by the load support member and return movement in a direction opposite the selected direction when the load is removed, at least one of the first and second link members having sufficient rigidity to transmit at least a portion of the load supported by the load support member to the other one of the body and the shaft;

a load sensor positioned to detect a load on the load support member in the selected direction; and an overload member with an attachment portion rigidly attached to the load support member and extending between the first and second link members, the overload member further having an engagement portion positioned toward the second end portion of the first link member at a location adjacent to the other one of the body and the shaft so as to be engaged by the first link member when the first link member flexes in the selected direction under the load supported by the load support member exceeding a selected amount.

54. The assembly of claim 53 wherein the overload member has another engagement portion positioned toward the second end portion of the second link member at a location adjacent to the other one of the body and the shaft so as to be engaged by the second link member when the second link member flexes in the direction opposite the selected direction when a force is applied to the load support member in the direction opposite the selected direction exceeding a selected amount.

55. A fluid-powered rotatable support member assembly usable with an assembly support platform configured to position the support member assembly, the support member assembly comprising;

a load support member having a support surface for supporting a load;

a body having a first end, a second end, a longitudinal axis extending between the first and second ends and a cavity extending along the longitudinal axis at least part way between the first and second ends;

a shaft rotatably disposed within the body and having a shaft axis generally aligned with the longitudinal axis of the body, one of the body and the shaft configured to be coupled to the assembly support platform and the other one of the body and the shaft being configured to provide a rotary drive to the load support member;

a linear-to-rotary force transmitting member positioned within the cavity of the body and mounted for longitudinal movement within the body generally aligned with the longitudinal axis in response to selective application of pressurized fluid thereto, the force transmitting member engaging the body and the shaft to translate longitudinal motion of the force transmitting member to rotational movement between the shaft and the body with a rotational force sufficient to selectively rotate the load support member relative to the assembly support platform in a rotational plane;

first and second link members in spaced apart relation, the first and second link members each being coupled between the load support member and the other one of the body and the shaft, the first and second link members each having a first end portion attached to the load support member and a second end portion attached the other one of the body and the shaft with at least one of the first and second link members configured to transmit the rotary drive of the other one of the body and the shaft to the load support member to selectively rotate the load support member about the longitudinal axis relative to the assembly support platform in the rotational plane as one of the shaft and the body rotates relative to the other, and with the first and second link members configured to permit movement of the load support member in a selected direction out of alignment with the rotational plane while restricting movement in directions out of alignment with the selected direction except rotation of the load support member in the rotational plane in response to the rotary drive transmitted thereto by the at least one of the first and second link members, the first and second link members each being arranged in a plane out of alignment with the selected direction and sufficiently flexible and resilient to permit flexure thereof in the selected direction under the load supported by the load support member and return movement in a direction opposite the selected direction when the load is removed, at least one of the first and second link members having sufficient rigidity to transmit at least a portion of the load supported by the load support member to the other one of the body and the shaft;

a load sensor positioned to detect a load on the load support member in the selected direction; and an overload member with an attachment portion rigidly attached to the load support member and extending toward the other one of the body and the shaft, the overload member further having an engagement portion positioned toward the second end portion of the first link member at a location adjacent to the other one of the body and the shaft so as to be engaged by the first link member when the first link member flexes in the selected direction under the load supported by the load support member exceeding a selected amount.

56. The assembly of claim 55 wherein the overload member has another engagement portion positioned toward the second end portion of the second link member at a location adjacent to the other one of the body and the shaft so as to be engaged by the second link member when the second link member flexes in the direction opposite the selected direction when a force is applied to the load support member in the direction opposite the selected direction exceeding a selected amount.

57. A fluid-powered rotatable support member assembly usable with an assembly support platform configured to position the support member assembly, the support member assembly comprising;

a load support member having a support surface for supporting a load;

a body having a first end, a second end, a longitudinal axis extending between the first and second ends and a cavity extending along the longitudinal axis at least part way between the first and second ends;

a shaft rotatably disposed within the body and having a shaft axis generally aligned with the longitudinal axis of the body, one of the body and the shaft configured to be coupled to the assembly support platform and the other one of the body and the shaft being configured to provide a rotary drive to the load support member;

a linear-to-rotary force transmitting member positioned within the cavity of the body and mounted for longitudinal movement within the body generally aligned with the longitudinal axis in response to selective application of pressurized fluid thereto, the force transmitting member engaging the body and the shaft to translate longitudinal motion of the force transmitting member to rotational movement between the shaft and the body with a rotational force sufficient to selectively rotate the load support member relative to the assembly support platform in a rotational plane;

first and second link members in spaced apart relation, the first and second link members each being coupled between the load support member and the other one of the body and the shaft, the first and second link members each having a first end portion attached to the load support member and a second end portion attached the other one of the body and the shaft with at least one of the first and second link members configured to transmit the rotary drive of the other one of the body and the shaft to the load support member to selectively rotate the load support member about the longitudinal axis relative to the assembly support platform in the rotational plane as one of the shaft and the body rotates relative to the other, and with the first and second link members configured to permit movement of the load support member in a selected direction out of alignment with the rotational plane while restricting movement in directions out of alignment with the selected direction except rotation of the load support member in the rotational plane in response to the rotary drive transmitted thereto by the at least one of the first and second link members, the first and second link members each being arranged in a plane out of alignment with the selected direction and sufficiently flexible and resilient to permit flexure thereof in the selected direction under the load supported by the load support member and return movement in a direction opposite the selected direction when the load is removed, at least one of the first and second link members having sufficient rigidity to transmit at least a portion of the load supported by the load support member to the other one of the body and the shaft;

a load sensor positioned to detect a load on the load support member in the selected direction;

an engagement member positioned toward the second end portion of the first link member at a location adjacent to the other one of the body and the shaft so as to be engaged by the first link member and limit movement thereof in the selected direction when the first link member flexes in the selected direction under the load supported by the load support member exceeding a selected amount; and another engagement member positioned toward the second end portion of one of the first and second link members at a location adjacent to the other one of the body and the shaft so as to be engaged by the one of the first and second link members and limit movement thereof in the direction opposite the selected direction when the one of the first and second link members flexes in the direction opposite the selected direction when a force is applied to the load support member in the direction opposite the selected direction exceeding a selected amount, the engagement member having a support rigidly attached to the load support member, and the another engagement member having a support rigidly attached to the load support member.

* * * * *